US006713736B2

(12) United States Patent
Suzuki et al.

(10) Patent No.: US 6,713,736 B2
(45) Date of Patent: Mar. 30, 2004

(54) METHOD AND APPARATUS FOR MANUFACTURING CYLINDRICAL MEMBER

(75) Inventors: Hitoshi Suzuki, Chiba (JP); Joji Nagahira, Kanagawa (JP); Hideyuki Nishida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/318,046

(22) Filed: Dec. 13, 2002

(65) Prior Publication Data

US 2003/0121951 A1 Jul. 3, 2003

(30) Foreign Application Priority Data

Dec. 28, 2001 (JP) ..... 2001-400043
Jan. 16, 2002 (JP) ..... 2002-007667
Jan. 16, 2002 (JP) ..... 2002-007668

(51) Int. Cl.[7] ..... H05B 6/10; H05B 6/38

(52) U.S. Cl. ..... 219/644; 219/635; 219/672; 118/622; 427/543; 34/247

(58) Field of Search ..... 219/643, 644, 219/635, 672, 674, 676; 118/620, 622, 623, 641, 642, 643; 427/457, 532, 541, 542, 543, 544; 34/247

(56) References Cited

U.S. PATENT DOCUMENTS 4,418,258 A * 11/1983 McNealy et al. ..... 219/643
5,902,509 A * 5/1999 Bruckner et al. ..... 219/644
6,093,917 A * 7/2000 Kawano et al. ..... 219/644

FOREIGN PATENT DOCUMENTS

JP 9-114111 5/1997
JP 10-239868 9/1998

* cited by examiner

*Primary Examiner*—Philip H. Leung
(74) *Attorney, Agent, or Firm*—Fitzpatrick, Cella, Harper & Scinto

(57) ABSTRACT

A cylindrical member including a cylindrical substrate and at least one coating layer thereon is formed through an applying step of applying a coating liquid on the cylindrical substrate and a drying step of drying the coating liquid that has been applied in the applying step by induction heating device to form the coating layer. The induction heating device is disposed in the interior of the cylindrical substrate. The induction heating device has an excitation coil for generating a magnetic flux in a direction perpendicular to the axial direction of the cylindrical member. The excitation coil is disposed along the inner surface of the cylindrical substrate.

26 Claims, 18 Drawing Sheets

METHOD AND APPARATUS FOR MANUFACTURING CYLINDRICAL MEMBER

BACKGROUND OF THE INVENTION

1. Field of the Invention

The present invention relates to a method and an apparatus for manufacturing a cylindrical member in the form of a cylindrical substrate having a coating layer formed thereon.

2. Related Background Art

In some processes for manufacturing a cylindrical member in the form of a cylindrical substrate having a coating layer, e.g. a process for manufacturing an organic photosensitive member for electrophotography in the form of a cylindrical substrate having a coating layer such as a photosensitive layer formed thereon, the coating layer is formed in the following manner. That is, a coating liquid such as a liquid solution for forming the photosensitive layer is applied on the substrate, and then the coating liquid is dried (i.e. the solvent in the coating liquid is evaporated) utilizing induction heating at a high frequency so that the coating layer is formed. Conventionally, such induction heating has been performed by supplying a high frequency current to an excitation coil that is wound in such a way as to surround the photosensitive member for electrophotography externally as shown in FIG. 18 (see e.g. Japanese Patent Application Laid-Open No. 9-114111).

In the arrangement shown in FIG. 18, a cylindrical substrate 3 made of an electrically conductive material is loosely inserted into an excitation coil 1' in such a way as to be coaxial with the coil 1'. On the outer peripheral surface of the cylindrical substrate, coating liquid 4 for forming a coating layer has been applied. The cylindrical substrate 3 is held by a chuck 25 of a lifting apparatus 24 so as to be moved up and down. While the cylindrical substrate 3 is moved up and down by the lifting apparatus 24 and rotated by a rotating mechanism (not shown), it is subjected to induction heating by the excitation coil to which a high frequency current is supplied from a high frequency oscillator 26 via a matching device 22. The temperature of the cylindrical substrate 3 is monitored by an optical fiber type radiation thermometer 23. The detection signal of the optical fiber type radiation thermometer 23 is fed back to the high frequency oscillator 26 via a control apparatus 21, so that the temperature of the cylindrical substrate 3 is controlled to be a predetermined value.

In the arrangement in which the excitation coil is provided outside the photosensitive member for electrophotography (as in the case of the above-described arrangement), a high degree of accuracy in the distance between the excitation coil and the coating liquid is required, since there is a risk that the excitation coil could touch the surface of the coating liquid and damage it.

Furthermore, in the induction heating, the cylindrical substrate is caused to generate heat in order for the coating liquid to be dried at the interface between the substrate and the coating liquid, and so the solvent in the coating liquid evaporates to the exterior of the substrate. So in the arrangement in which the excitation coil is disposed outside the cylindrical substrate, the presence of the coil is apt to disturb the drying or evaporation to invite non-uniformity in drying. This might adversely affect images to be formed on the photosensitive member.

In addition, with the evaporation of the solvent, its concentration in the circumferential atmosphere will increase. This invites a risk of catching fire when the temperature of the excitation coil is increased by its own operation.

On the other hand, in the arrangement in which heat required for a cylindrical member is generated locally, a complex mechanism and a complicated controlling process are necessary for moving the excitation coil up and down relative to the cylindrical member.

Drying methods that utilize heated air have been also conventionally adopted as simple methods for drying coating liquid (see e.g. Japanese Patent Application Laid-Open No. 10-239868). However, such methods are suffering from various disadvantages such as slowness in raising the temperature of a cylindrical substrate up to a prescribed temperature, non-uniformity in the temperature on the cylindrical substrate and a risk of catching fire due to the heated air when a solvent is used. Therefore, such methods are not suitable for manufacturing the cylindrical member, especially when reduction of the manufacturing time is desired.

SUMMARY OF THE INVENTION

An object of the present invention is to provide a method and an apparatus for manufacturing a cylindrical members that can produce cylindrical members safely with small variation in their qualities and at an advantageous cost.

A method according to the present invention is a method for manufacturing a cylindrical member including a cylindrical substrate and at least one coating layer thereon, comprising:

an applying step of applying a coating liquid on the cylindrical substrate; and a drying step of drying the coating liquid that has been applied in the applying step by an induction heating means to form the coating layer;

wherein, the induction heating means is disposed in the interior of the cylindrical substrate;

the induction heating means includes an excitation coil to generate a magnetic flux in a direction perpendicular to the axial direction of the cylindrical member; and the excitation coil is disposed along the inner surface of the cylindrical substrate.

An apparatus according to the present invention is an apparatus for manufacturing a cylindrical member including a cylindrical substrate and at least one coating layer thereon, comprising:

an applying means for applying a coating liquid on the cylindrical substrate; and a drying means for drying the coating liquid that has been applied by the applying means by induction heating to form the coating layer;

wherein, the drying means includes induction heating means for performing induction heating;

the induction heating means is disposed in the interior of said cylindrical substrate;

the induction heating means includes an excitation coil to generate a magnetic flux in a direction perpendicular to the axial direction of the cylindrical substrate; and the excitation coil is disposed along the inner surface of the cylindrical substrate.

BRIEF DESCRIPTION OF THE DRAWINGS

(In FIG. 2, an illustration of a core is omitted.)

FIGS. 5 and 6 show an arrangement in which the excitation coil has a semi-circular shape instead of extending all along the circumference of the inner surface of the cylindrical substrate and the cylindrical substrate having coating liquid applied thereon is to be rotated, wherein FIG. 5 is a cross sectional view as seen from the axial direction of the cylindrical substrate, while FIG. 6 is a longitudinal cross sectional view. (In FIG. 6 illustration of a core is omitted.)

FIGS. 7, 8 and 9 show an arrangement in which the excitation coil has a semi-circular shape instead of extending all along the inner circumference of the cylindrical substrate, wherein FIG. 7 is a cross sectional view as seen from the axial direction of the cylindrical substrate, FIG. 8 is a longitudinal cross sectional view as seen from the direction of arrow f8 in FIG. 7, and FIG. 9 is a longitudinal cross sectional view as seen from the direction of arrow f9 in FIG. 7. (In FIGS. 8 and 9, a core is explicitly illustrated.)

DETAILED DESCRIPTION OF THE PREFERRED EMBODIMENTS

Figure 1:
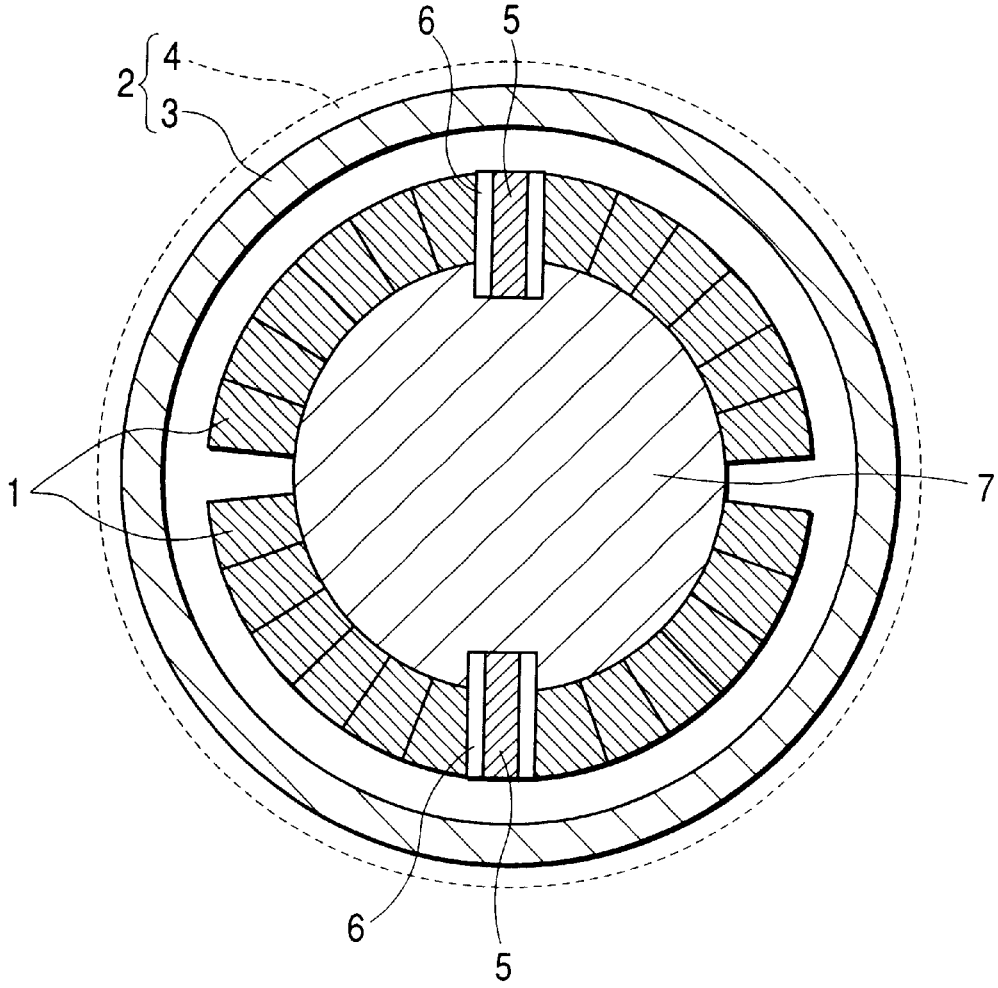
FIG. 1 shows an arrangement in which an excitation coil is configured to extend all along the circumference of the inner surface of a cylindrical substrate, in its cross section as seen from the axial direction of the cylindrical substrate.

In the following, the present invention will be specifically described.

According to the present invention, an induction heating means having an excitation coil is placed at a position inside a cylindrical substrate on which coating liquid such as a photosensitive layer has been applied, and for drying the coating liquid. With such an arrangement of the invention, in the manufacturing process of, for example, a photosensitive member for electrophotography composed of a cylindrical substrate having a coating layer such as a photosensitive layer formed thereon, a risk of damaging of the coating layer such as a photosensitive layer due to contact or collision with the induction heating means can be avoided. Therefore, the requirement for accuracy of the distance between the excitation coil and the coating liquid can be loosened.

Furthermore, with the above-mentioned arrangement according to the present invention, since the excitation coil is disposed inside the cylindrical substrate, when the cylindrical substrate is caused to generate heat, the solvent is dried or evaporated from the interface with the cylindrical substrate. In other words, the solvent evaporates to the exterior of the cylindrical substrate and diffused away from the heating means. Therefore, the drying will be facilitated and the degree of non-uniformity in drying will be reduced.

Still further, even when the concentration of the evaporated solvent in the circumferential atmosphere becomes high, a risk of catching fire can be reduced by disposing the induction heating means inside the cylindrical substrate, since the solvent is separated from the excitation coil by the cylindrical substrate and the distance between the excitation coil and the solvent is enlarged.

Seen from the view point of temperature distribution control, it is possible to reduce the degree of non-uniformity in heat generation by configuring the excitation coil to extend all along the circumference of the inner surface of the cylindrical substrate.

In order to have a magnetic flux generated from the excitation coil in a direction perpendicular to the axial direction of the cylindrical member, it is preferable that the excitation coil be configured to be folded in the longitudinal direction of the cylindrical substrate.

It is preferable that both longitudinal ends of the excitation coil be arranged to stay within the space defined or limited by both longitudinal ends of the cylindrical substrate, since such an arrangement would avoid overheating at both ends of the cylindrical substrate to enhance the degree of uniformity of the heat generation and to enhance electrical power consumption efficiency.

When the distance between the cylindrical substrate and the excitation coil is large, the power factor may become small to invite low power source efficiency. So it is preferable to arrange the excitation coil in such a way that the distance between the excitation coil and the inner wall of the cylindrical substrate is more than 0 mm and not more than 5 mm.

The apparatus for manufacturing cylindrical members according to the present invention may be constructed to have a driving means for driving the induction heating means that has the excitation coil in a direction perpendicular to the longitudinal direction of the cylindrical substrate so as to change the distance between the induction heating means and the inner surface of the cylindrical substrate.

Composing the excitation coil with one single coil can be costly, since the configuration of the coil would be complex. Therefore, it is sometimes cost effective to arrange a plurality of coils having simple configurations that are easy to produce in a serial or parallel manner so as to be regarded as one coil.

In order to reduce the degree of non-uniformity in heat generation, it is necessary to arrange the excitation coil along the inner surface of the cylindrical substrate, irrespective of whether the excitation coil is composed of a single coil or a plurality of coils.

Furthermore, in the case in which the excitation coil is configured to extend all along the circumference of the inner surface of the cylindrical substrate, it is possible to make a magnetic flux permeating in the cylindrical substrate uniform in the axial direction of the cylindrical substrate, and it is also possible to make the distribution of heat generation along the circumference uniform. Therefore, it is possible to heat the cylindrical substrate without rotating the cylindrical substrate or the drying means (or induction heating means), and so designing of the structure becomes easy.

It is preferable that the induction heating means include the excitation coil and a core provided in the interior space of the excitation coil, in view of controllability of a magnetic flux to be generated.

It is preferable that both longitudinal ends of the core be arranged to stay within the space defined or limited by both longitudinal ends of the cylindrical substrate, since such an arrangement would reduce the magnetic flux passing through both end portions of the cylindrical substrate to avoid overheating at both end portions, so that the temperature difference between the end portions and the intermediate or central portion would be reduced.

It is preferable to construct the core with a plurality of divisional cores, since it is possible to perform drying of coating liquid applied on the cylindrical substrate uniformly by adjusting the lengths in the longitudinal direction or dispositions of the divisional cores appropriately.

Specifically, with the following divisional core arrangements (1) to (3), it is possible to avoid overheating at both end portions of the cylindrical substrate more effectively, so that the temperature difference between the end portions and the intermediate or central portion would be reduced.

(1) The core is divided in the longitudinal direction into at least three divisional cores, and the length, in the longitudinal direction, of the divisional core that is intermediately disposed with respect to the longitudinal direction is shorter than the length, in the longitudinal direction, of each of the divisional cores that are disposed at both ends.

(2) The core is divided in the longitudinal direction into at least three divisional cores, and the distance between the divisional core that is intermediately disposed with respect to the longitudinal direction and the inner surface of the cylindrical substrate is larger than the distance between each of the divisional cores that are disposed at both ends and the inner surface of the cylindrical substrate.

(3) The core is divided in the longitudinal direction into at least four divisional cores, and the distance between the divisional cores that are intermediately disposed with respect to the longitudinal direction is larger than the distance between each of the divisional cores that are disposed at both ends and the divisional core adjacent thereto.

While, as set forth above, it is preferable that both longitudinal ends of the core be arranged to stay within the space defined or limited by both longitudinal ends of the cylindrical substrate, it is preferable that the length (or distance) between both longitudinal ends of the core be more than one-third of the length (or distance) between both longitudinal ends of the cylindrical substrate.

It is preferable that the excitation coil be secured to a holder that is coaxial with the cylindrical substrate, when induction-heating the coating liquid applied on the cylindrical substrate. In the case in which the induction heating means includes the core in addition to the excitation coil, it is preferable that the core be also secured to that holder.

It is preferable to harden the excitation coil using an adhesive or varnish in order to maintain its configuration extending all along the periphery of the inner surface of the cylindrical substrate.

It is preferable to insulate the whole of the excitation coil or the whole of the induction heating means with a tube made of a non-magnetic material in view of breakage of the coating of the coil or in order to prevent a worker from getting an electric shock.

Cylindrical members to which the method and apparatus according to the present invention are applied may be, for example, heating rollers or films. Any type of cylindrical member can be heated by the method and apparatus according to the invention, as long as its cylindrical substrate is made of a metal material. Especially when applied to cylindrical substrate as a photosensitive member for electrophotography, advantageous effects of the invention are remarkably brought about. Specifically, the method or apparatus according to the invention has high heating efficiency by virtue of its small size and low heat capacity, and can form a uniform coating layer (such as a photosensitive layer). Therefore, the resultant photosensitive member would have good electrophotographic properties. Generally, in the manufacturing process of an organic photosensitive member for electrophotography, a coating liquid such as a solution for forming a photosensitive layer is applied on a cylindrical substrate, and then the applied liquid is dried to form a layer such as a photosensitive layer. An organic photosensitive substrate for electrophotography is made by the above process or by repeating the above process for a few times.

In the following, embodiments of the method and apparatus for manufacturing a cylindrical member according to the present invention will be described with reference to the annexed drawings. It should be noted, however, that the present invention is not limited to the following embodiments, and various modifications and variations can be made within the scope of the inventive concept.

Figure 2:
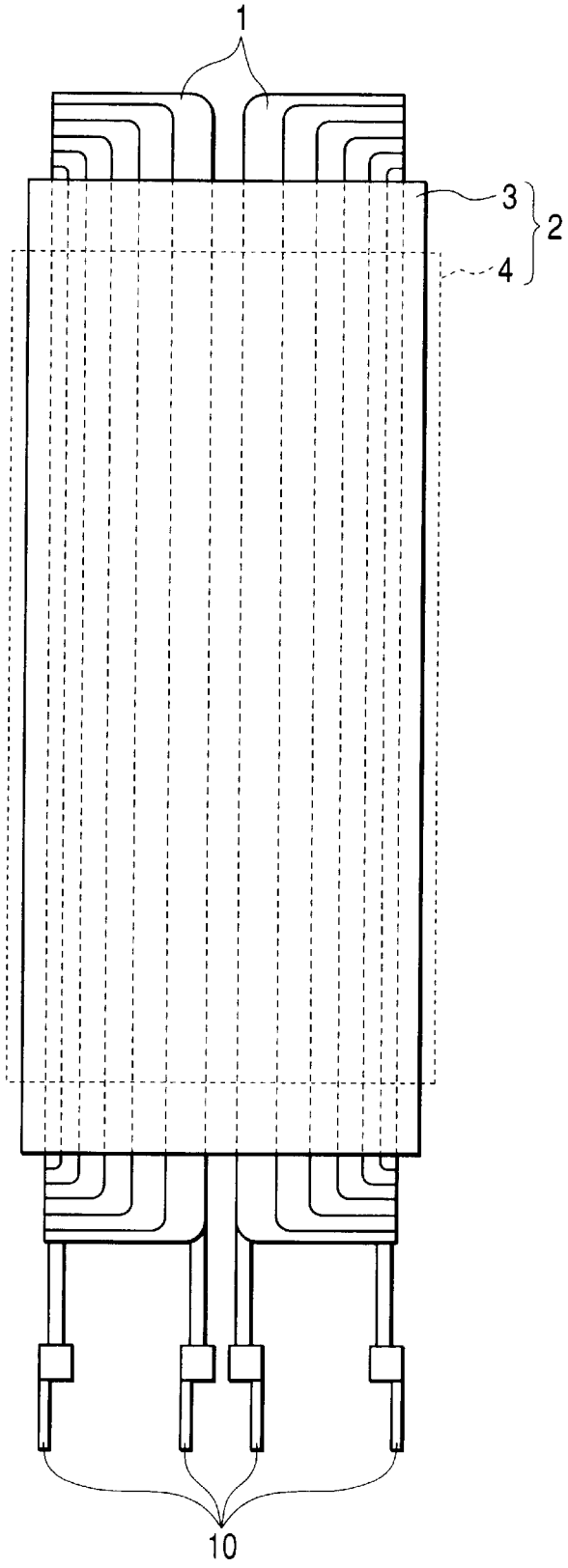
FIG. 2 shows an arrangement in which an excitation coil is configured to extend all along the circumference of the inner surface of a cylindrical substrate, in its longitudinal cross section.

FIGS. 1 and 2 are drawings showing an embodiment of the invention in which an excitation coil is configured to extend all along the circumference of the inner surface of a cylindrical substrate. FIG. 1 is a cross sectional view as seen from the axial direction of the cylindrical member, while FIG. 2 is a longitudinal cross sectional view. (An illustration of a core is omitted in FIG. 2.)

In FIGS. 1 and 2, there is illustrated an excitation coil 1, a cylindrical member 2, a cylindrical substrate 3, a coating liquid (or coating layer) 4 applied on the cylindrical substrate, cores 5, spacers 6, a holder 7 and lead terminals 10.

In the structure shown in FIG. 1, the induction heating means having the holder 7 that supports the excitation coil 1 and the core 5 is disposed in the interior of the cylindrical substrate. A high frequency current is supplied from a high frequency oscillator (not shown) to the induction heating means via a matching device (not shown), so that the cylindrical substrate 3 is heated. Thus, the coating liquid (or coating layer) 4 applied on the outer surface of the cylindrical substrate 3 is dried, and the cylindrical member 2 is produced.

As the material of the core 5, a ferromagnetic material is used so that a loss would be reduced. Since the core 5 has an electrical conductivity, it is necessary to insulate the core 5 from the excitation coil. So the spacer(s) 6 made of a non-magnetic material is used. As in the spacer 6, the holder 7 is also made of a non-magnetic material in order to avoid a loss.

While in the structure shown in FIGS. 1 and 2, the core is used, it is possible to heat the cylindrical substrate 3 for drying without the core 5.

The excitation coil 1 disposed in the interior of the cylindrical substrate 3 is configured to extend all along or nearly all along the circumference of the inner surface of the cylindrical substrate 3. The excitation coil 1 is supported by the holder 7 made of a non-magnetic material.

The excitation coil 1 is not necessarily required to extend all along the circumference of the inner surface of the cylindrical substrate as show in FIGS. 1 and 2. Alternatively, the coil 1 (or the induction heating means including the coil 1) or the cylindrical substrate may be rotated in order for the cylindrical substrate 3 to be heated uniformly. However, with the excitation coil 1 that is configured to extend all along the circumference of the inner surface of the cylindrical substrate 3, it is possible to make a magnetic flux permeating in the cylindrical substrate 3 uniform in the axial direction of the cylindrical substrate 3, and it is also possible to make the distribution of heat generation along the circumference uniform. Therefore, it is possible to heat the cylindrical substrate 3 without rotating the cylindrical substrate or the induction heating means, and so designing of the structure becomes easy.

Figure 3:
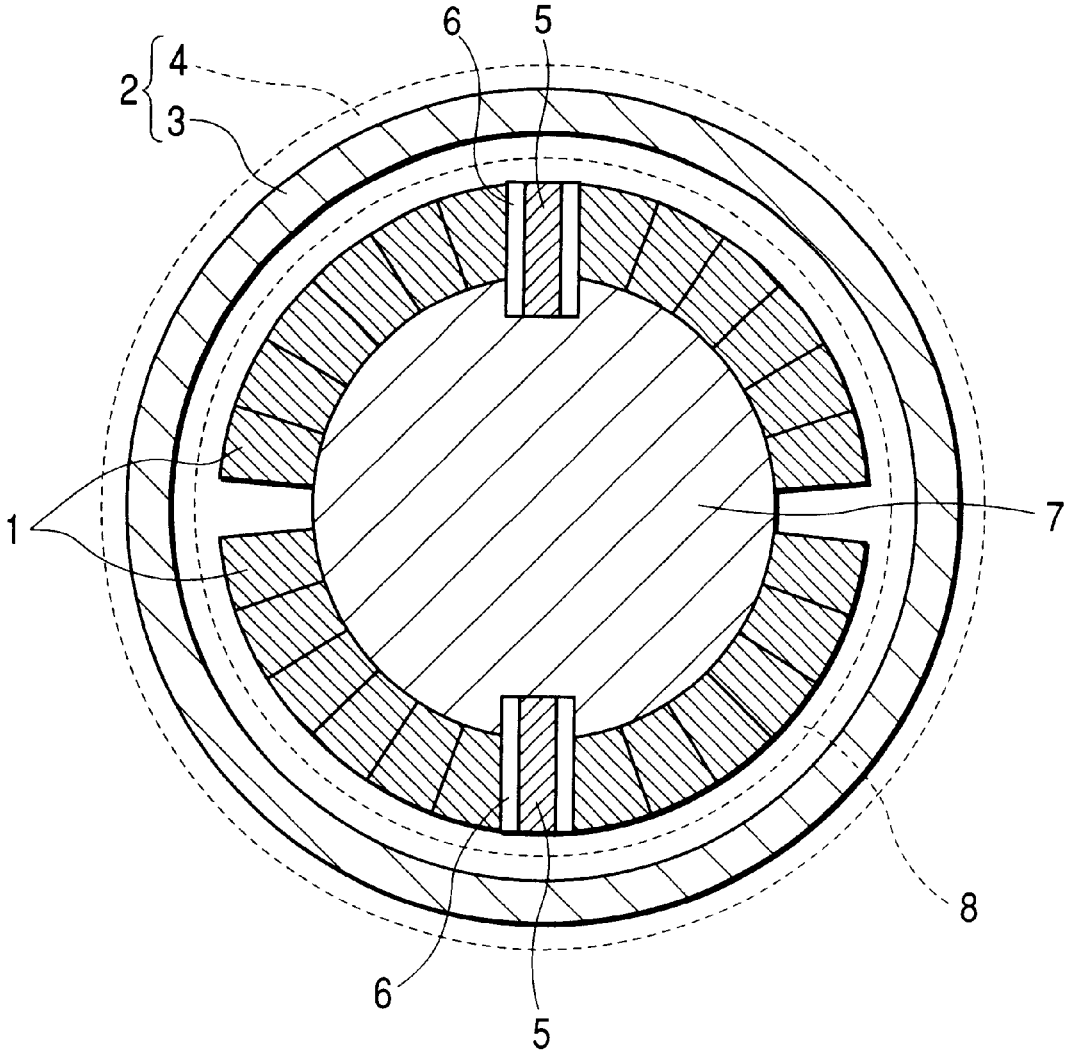
FIG. 3 showing an arrangement similar to the arrangement shown in FIG. 1, in its cross section as seen from the axial direction of the cylindrical substrate, wherein the excitation coil same as that shown in FIG. 1 is covered by an insulating tube.

FIG. 3 is a cross sectional view as seen from the axial direction of the cylindrical substrate, showing another arrangement in which the excitation coil 1 as shown in FIG. 1 is covered by an insulating tube 8. It should be understood that a cross sectional view in the longitudinal direction (which is omitted) of this arrangement would be the same as FIG. 2 except for the existence of the insulating tube. In FIG. 3, there is illustrated an excitation coil 1, a cylindrical member 2, a cylindrical substrate 3, a coating liquid (or a coating layer) 4 applied on the cylindrical substrate, cores 5, spacers 6, a holder 7, an insulating tube 8 and lead terminals 10.

In the arrangement shown in FIG. 3, drying of the coating liquid (or coating layer) 4 applied on the cylindrical substrate 3 is performed in the same manner as in the arrangement shown in FIGS. 1 and 2.

Figure 4:
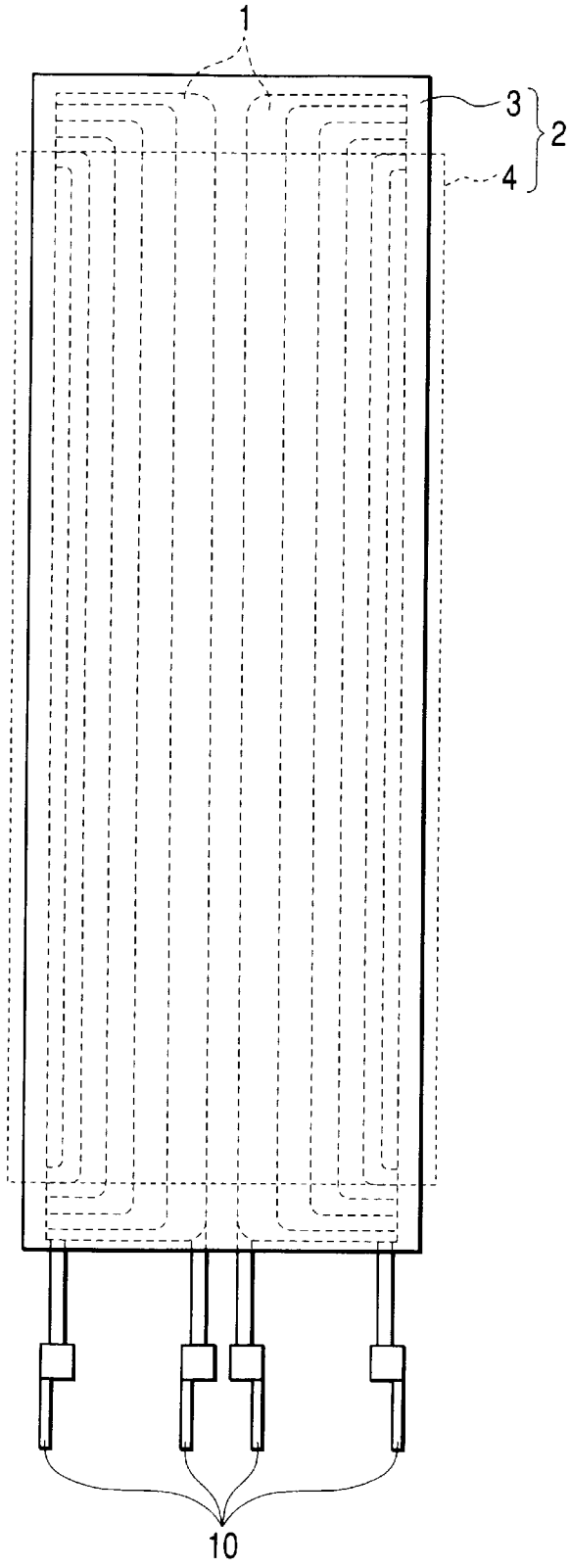
FIG. 4 is a longitudinal cross sectional view of an arrangement in which both longitudinal ends of the excitation coil are arranged to stay within the space defined by both longitudinal ends of the cylindrical substrate.

FIG. 4 is a longitudinal cross sectional view of another arrangement in which both longitudinal ends of the excitation coil stay within the space defined by both longitudinal ends of the cylindrical substrate, in other words, an arrangement in which the length of the coil is shorter than the length of the cylindrical substrate. (In FIG. 4, an illustration of a core is omitted.) It should be understood that a cross sectional view as seen from the axial direction (which is omitted) of this arrangement would be the same as FIG. 1.

In FIG. 4, there is illustrated an excitation coil 1, cylindrical member 2, cylindrical substrate 3, a coating liquid (or a coating layer) 4 applied on the cylindrical substrate and lead terminals 10.

In the arrangement shown in FIG. 4, drying of the coating liquid (or coating layer) 4 applied on the cylindrical substrate 3 is performed in the same manner as in the arrangement shown in FIGS. 1 and 2.

In the arrangement shown in FIG. 4, the length of the excitation coil is shorter than the length of the cylindrical substrate, in contrast to the arrangement shown in FIG. 2. Therefore, it is possible to reduce the magnetic flux passing through both end portions of the cylindrical substrate 3 to control heat generation at the end portions of the cylindrical substrate 3. Thus, it is possible to reduce the temperature difference between the central portion and the end portions of the cylindrical substrate 3. In other words, the temperature for heating the coating liquid (or coating layer) applied on the cylindrical substrate 3 can be made evener.

Figure 5:
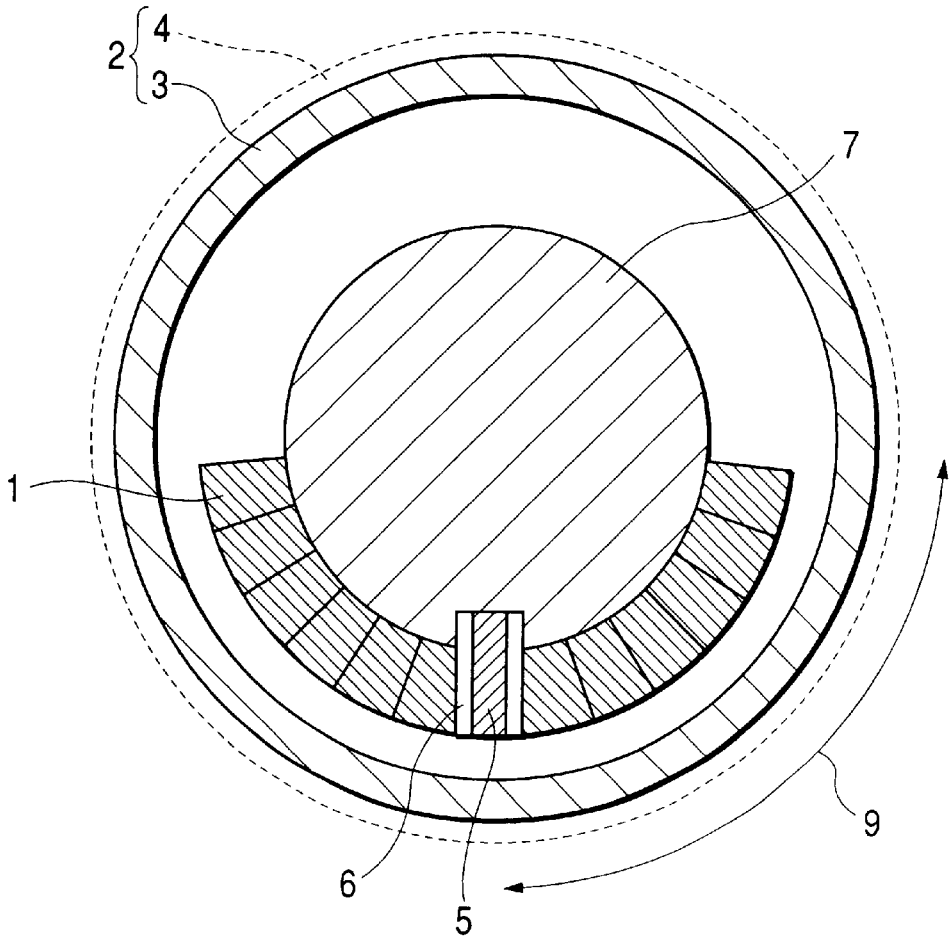
Figure 6:
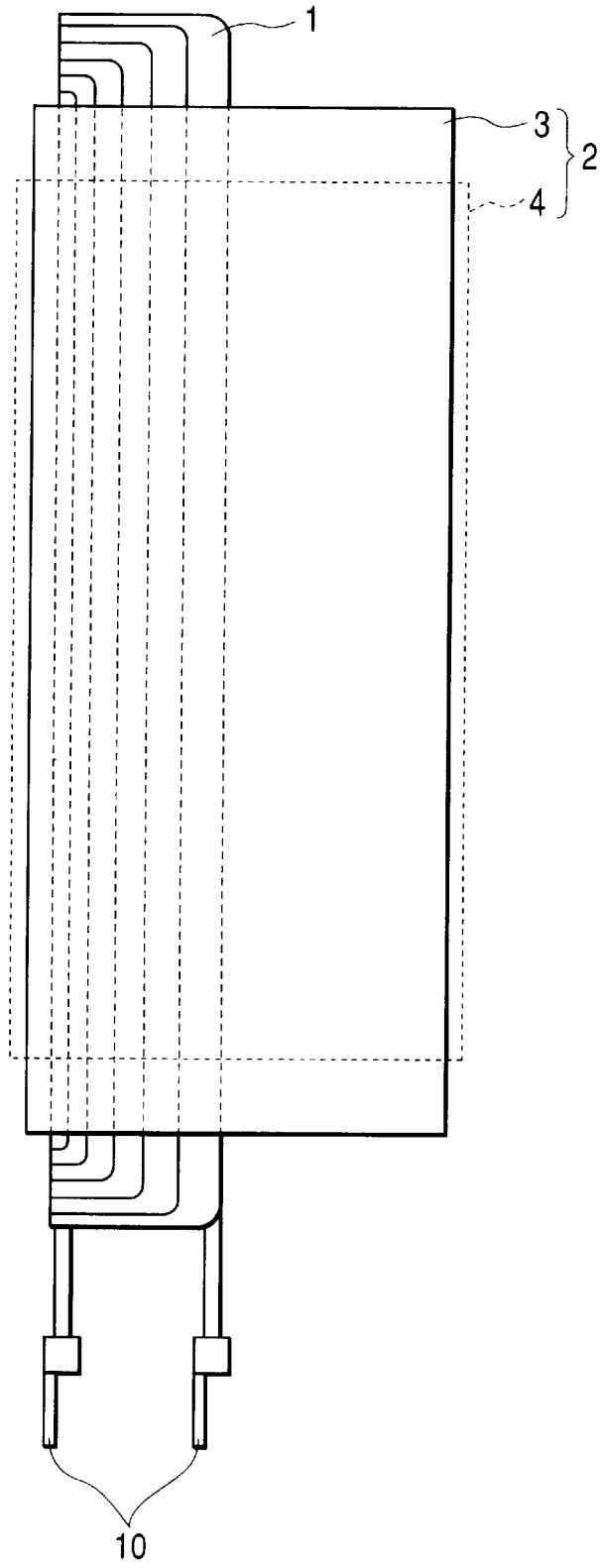

FIGS. 5 and 6 show another arrangement in which the excitation coil has a semi-circular shape instead of extending all along the circumference of the inner surface of the cylindrical substrate and the cylindrical substrate having coating liquid applied thereon is to be rotated. FIG. 5 is a cross sectional view as seen from the axial direction of the cylindrical substrate, while FIG. 6 is a longitudinal cross sectional view. (An illustration of a core is omitted in FIG. 6.)

In FIGS. 5 and 6, there is illustrated an excitation coil 1, cylindrical member 2, cylindrical substrate 3, a coating liquid (or a coating layer) 4 applied on the cylindrical substrate, a core 5, a spacer 6, a holder 7, an insulating tube 8 and lead terminals 10. In FIG. 5, reference numeral 9 designates the direction of rotation of the cylindrical substrate 3.

In the arrangement shown in FIGS. 5 and 6, drying of the coating liquid (or coating layer) 4 applied on the cylindrical substrate 3 is performed in the same manner as in the arrangement shown in FIGS. 1, 2 and 3 except that the induction heating is effected while the cylindrical substrate on which the coating liquid (or coating layer) has been applied is rotated.

As will be apparent, the length of the excitation coil may be arranged to be shorter than the length of the cylindrical substrate as in the case of the arrangement shown in FIG. 4, or the excitation coil may be covered with an insulating tube as in the case of the arrangement shown in FIG. 3. The arrangement shown in FIGS. 5 and 6 may be modified to rotate the induction heating means having the excitation coil 1 instead of rotating the cylindrical substrate 3.

Figure 7:
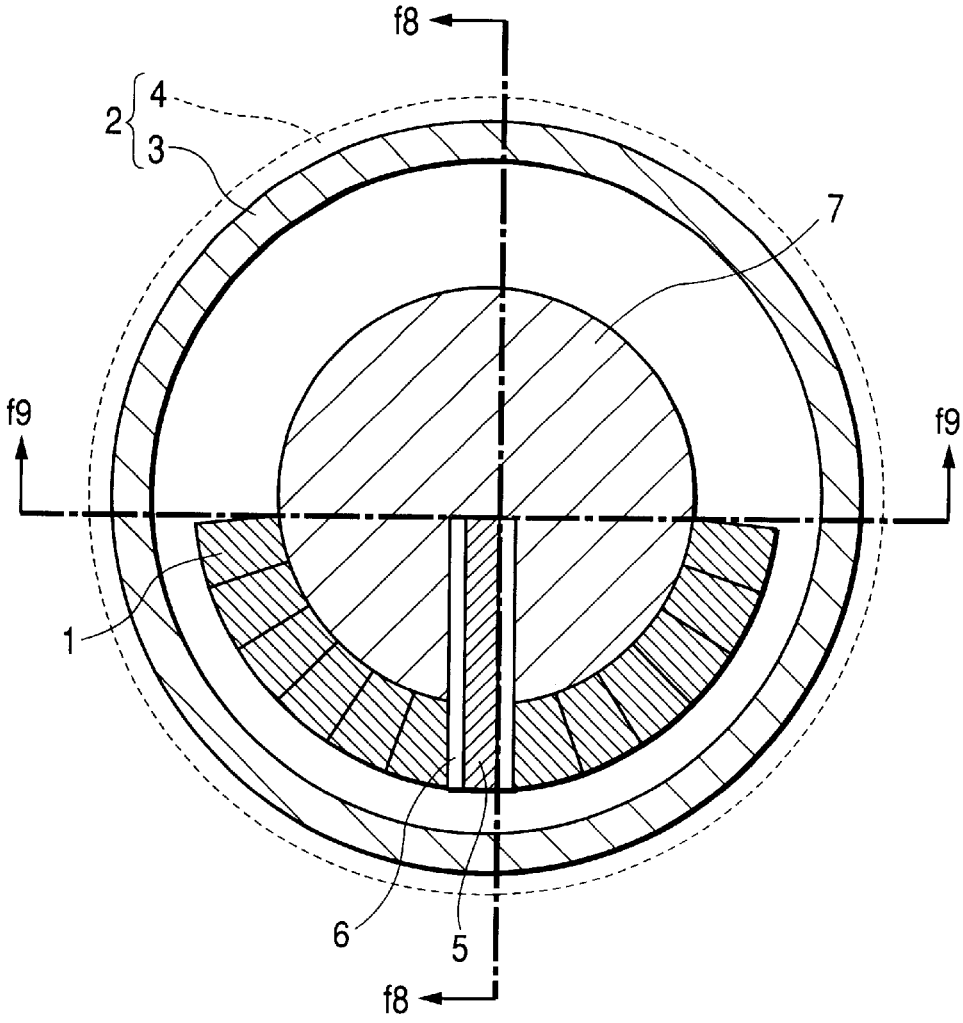
Figure 8:
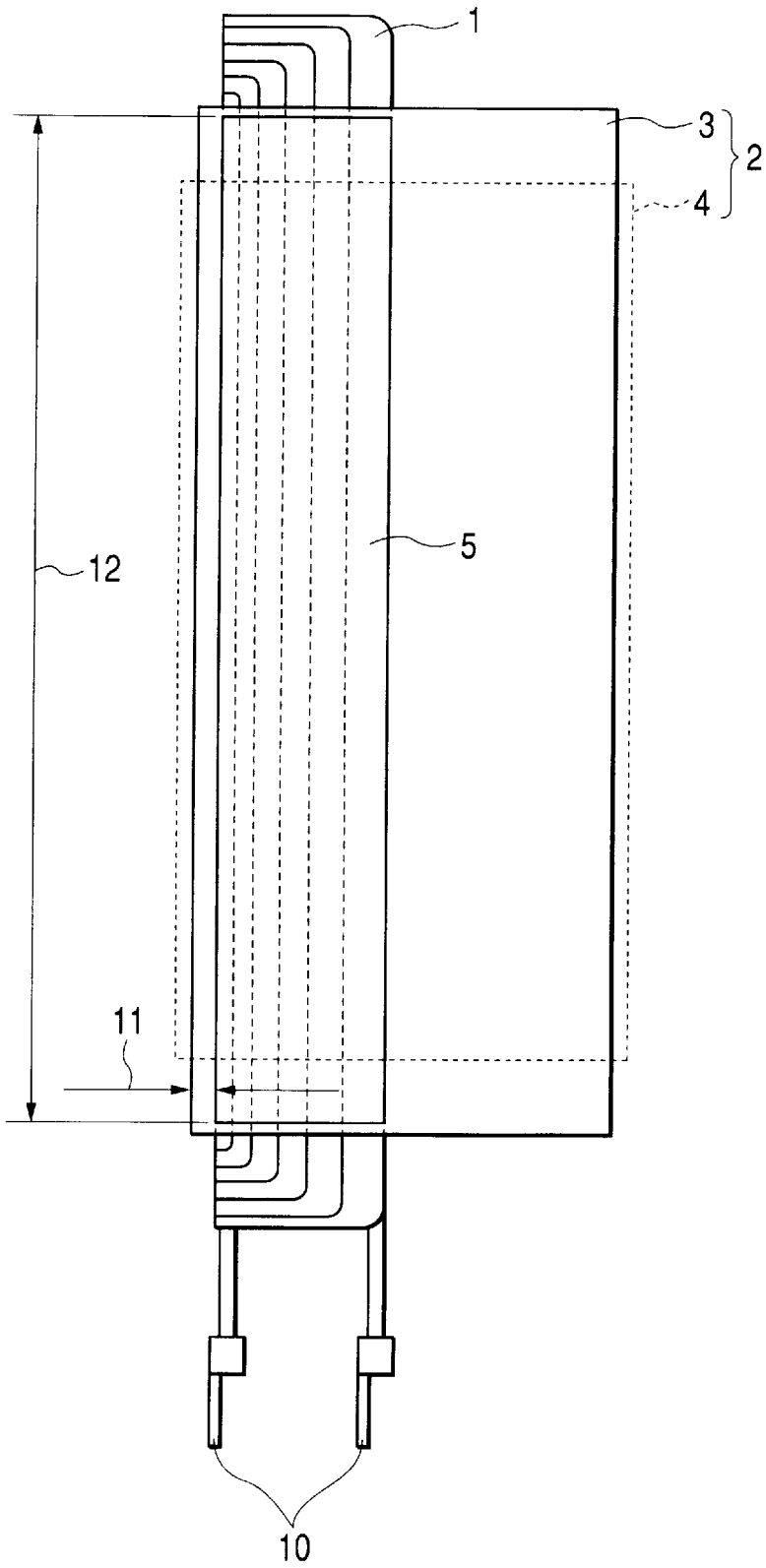
Figure 9:
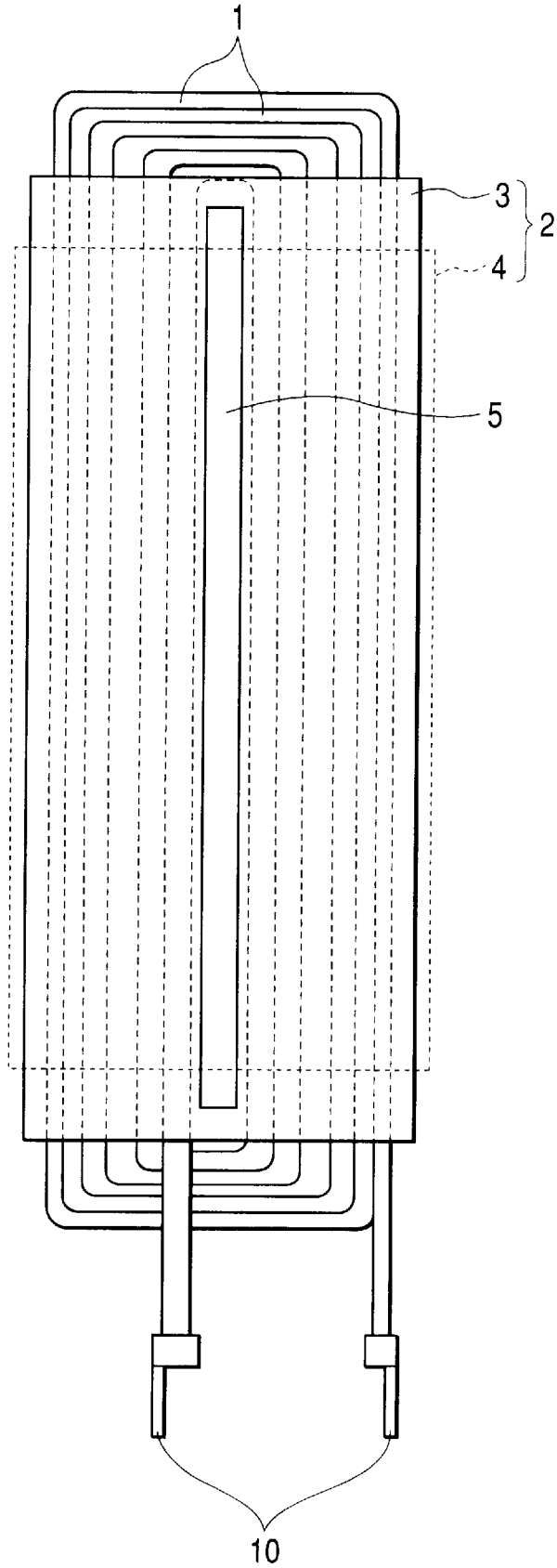

FIGS. 7, 8 and 9 show another arrangement in which the excitation coil has a semi-circular shape instead of extending all along the inner circumference of the cylindrical substrate. FIG. 7 is a cross sectional view as seen from the axial direction, FIG. 8 is a longitudinal cross sectional view as seen from the direction of arrow f8 in FIG. 7. FIG. 9 is a longitudinal cross sectional view as seen from the direction of arrow f9 in FIG. 7. (In FIGS. 8 and 9, a core is explicitly illustrated.) In the arrangement shown in FIGS. 7, 8 and 9, both longitudinal ends of the core stay within the space defined between both longitudinal ends of the cylindrical substrate, in other words, the length of the core is shorter than the length of the cylindrical substrate.

In FIGS. 7, 8 and 9, there is illustrated an excitation coil 1, a cylindrical member 2, a cylindrical substrate 3, a coating liquid (or a coating layer) 4 applied on the cylindrical substrate, a core 5, a spacer 6, a holder 7 and lead terminals 10. In FIGS. 7, 8 and 9, reference numeral 11 denotes the distance between the core and the cylindrical substrate, reference numeral 12 denotes the length of the core, and arrows f8 and f9 indicate cross sections shown in FIGS. 8 and 9, respectively.

In the arrangement shown in FIGS. 7, 8 and 9, drying of the coating liquid (or coating layer) 4 applied on the cylindrical substrate 3 is performed in the same manner as in the arrangement shown in FIGS. 1 and 2.

In the arrangement shown in FIGS. 7, 8 and 9, both ends of the core stay within the space defined between both longitudinal ends of the cylindrical substrate. So, it is possible to reduce the magnetic flux passing through both end portions of the cylindrical substrate 3 to control heat generation at the end portions of the cylindrical substrate 3. Thus, it is possible to reduce the temperature difference between the central portion and the end portions of the cylindrical substrate 3. In other words, the temperature for heating the coating liquid (or coating layer) applied on the cylindrical substrate 3 can be made evener.

In the following, arrangements which utilize divisional cores will be described. In connection with this, modifications of the disposition of the divisional cores and arrangements which utilizes plural types of cores having different shapes will also be described.

With regard to the following arrangements, the length of the excitation coil may be arranged to be shorter than the length of the cylindrical substrate as in the case of the arrangement shown in FIG. 4, and the excitation coil may be covered with an insulating coil as shown in FIG. 3. In addition, the induction heating means having the excitation coil may be arranged to be rotated.

In all of the following arrangements, the length of the excitation coil is longer than the length of the cylindrical substrate, the length, in the longitudinal direction, of the core is shorter than the length of the cylindrical substrate and the excitation coil has a semi-circular shape instead of extending all along the circumference of the inner surface of the cylindrical substrate so that the cylindrical substrate on which a coating liquid has been applied is to be rotated. However, as will be apparent, the excitation coil may be configured to extend all along the circumference of the inner surface of the cylindrical substrate as in the case of the arrangement shown in FIGS. 1 and 2, and the length of the excitation coil may be arranged to be shorter than the length of the cylindrical substrate as in the case of the arrangement shown in FIG. 4. In addition, the excitation coil may be covered with an insulating tube as shown in FIG. 3.

In the case in which the core is divided, that is, in the arrangement that utilizes the divisional cores, the term "both longitudinal ends of the core" refers to the outer ends of the divisional cores that are disposed at both ends in a series of divisional cores, wherein the outer ends mean the ends that are not facing intermediately disposed divisional cores.

Figure 10:
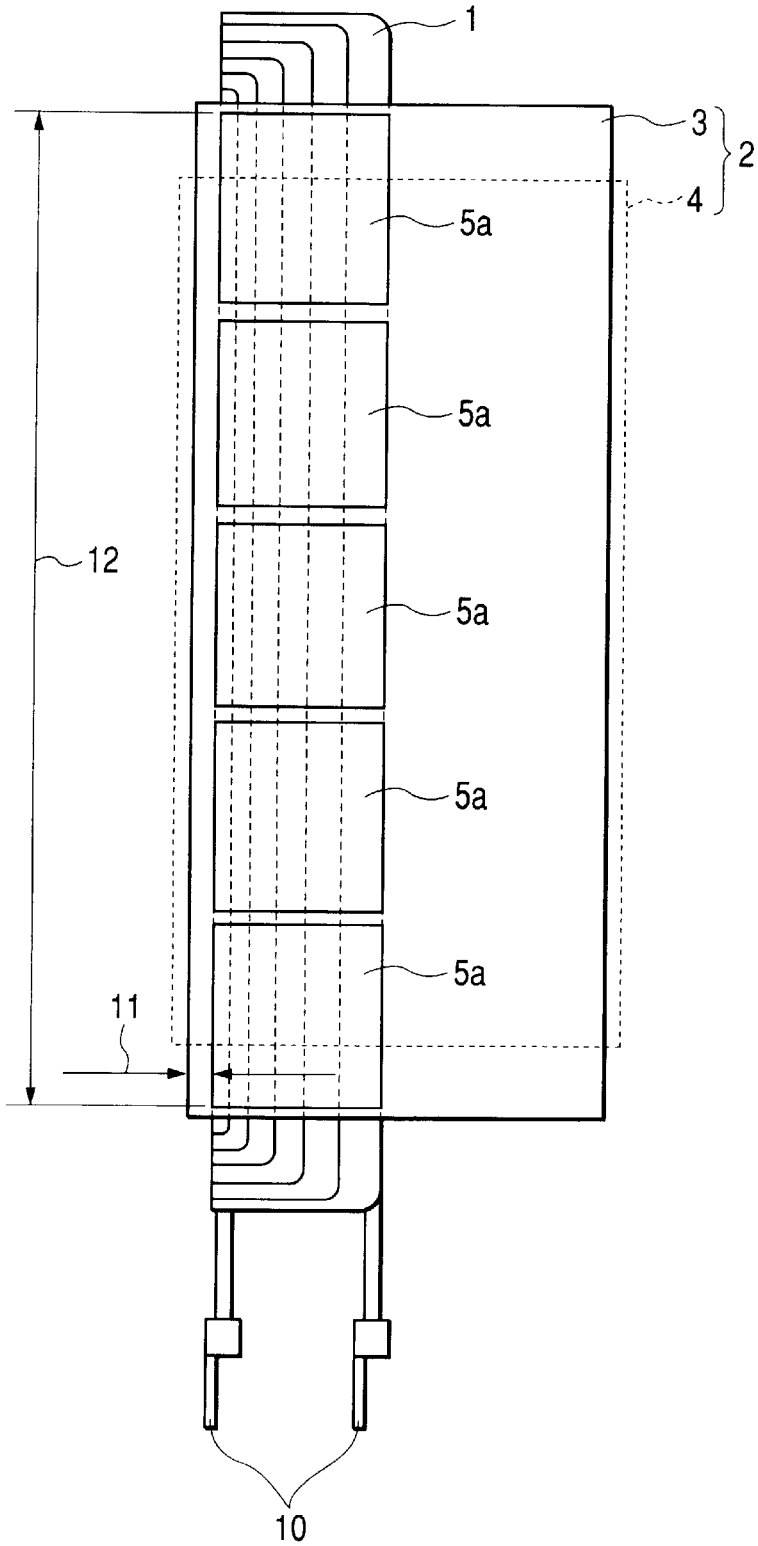
FIG. 10 shows an arrangement in which a core is divided, in its cross section as seen from the axial direction of the cylindrical substrate.

FIG. 10 shows an arrangement in which the core is divided. FIG. 10 is a cross sectional view as seen from the axial direction of the cylindrical substrate.

In FIG. 10, there is illustrated an excitation coil 1, a cylindrical member 2, a cylindrical substrate 3, a coating liquid (or a coating layer) 4, divisional cores 5*a* and lead terminals 10. In FIG. 10, reference numeral 11 denotes the distance between the divisional cores and the cylindrical substrate, and reference numeral 12 denotes the length in the longitudinal direction, of the core.

While five divisional cores 5*a* are used in the arrangement shown in FIG. 10, it is easy to adapt the arrangement to changes of the length of the cylindrical substrate or the length of the excitation coil by changing the number of divisional cores or by using a combination of plural types of divisional cores having different lengths in the longitudinal direction.

Figure 11:
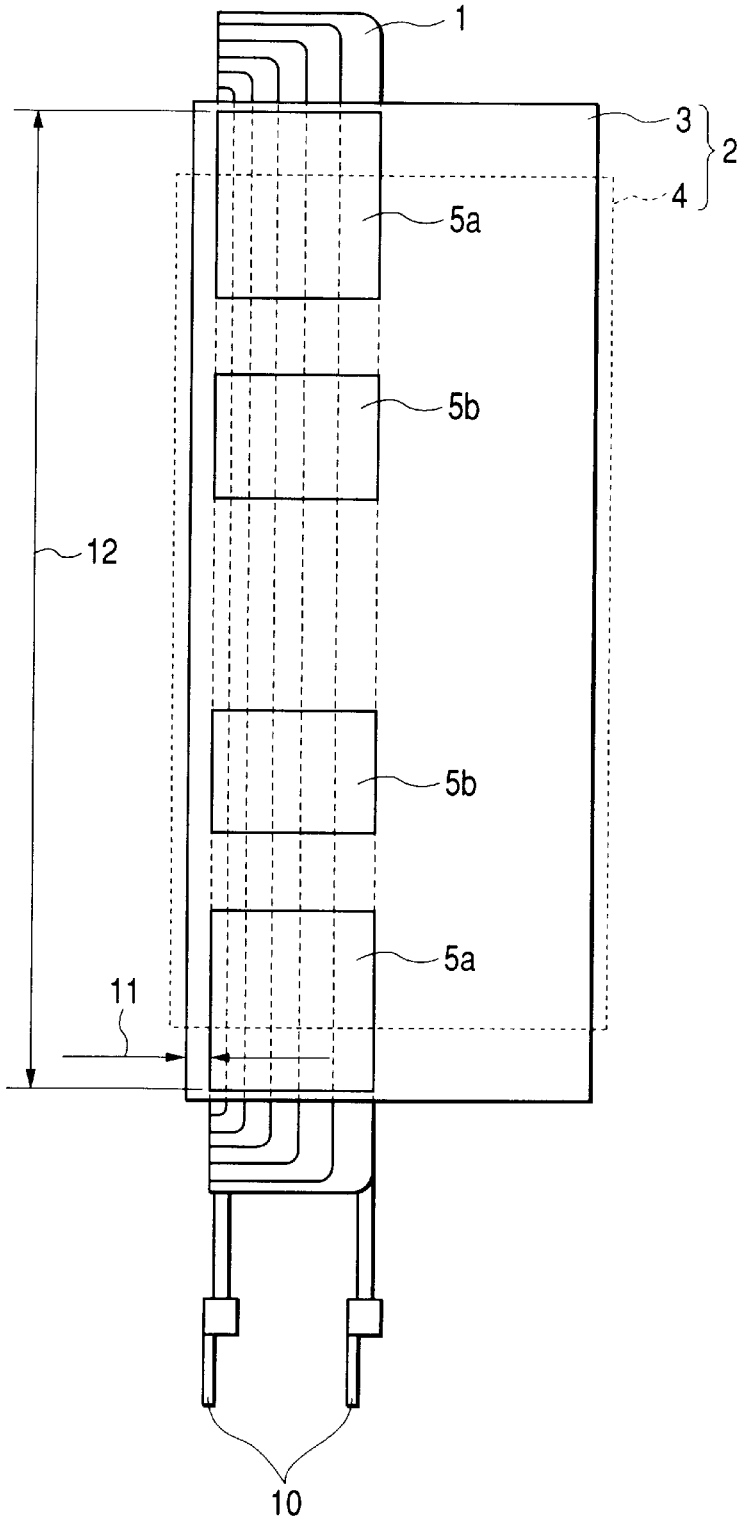
FIG. 11 shows an arrangement in which a core is divided in the longitudinal direction into four divisional cores, wherein the lengths, in the longitudinal direction, of the two divisional cores that are intermediately disposed with respect to the longitudinal direction are shorter than the lengths, in the longitudinal direction, of the two divisional cores that are disposed at both ends, and the distance between the two divisional cores that are intermediately disposed with respect to the longitudinal direction is larger than the distance between each of the two divisional cores that are disposed at the ends and the divisional core adjacent thereto.

FIG. 11 shows another arrangement in which the core is divided in the longitudinal direction into four divisional cores, wherein the lengths in the longitudinal direction, of the two divisional cores that are intermediately disposed with respect to the longitudinal direction are shorter than the lengths in the longitudinal direction, of the two divisional cores that are disposed at both ends, and the distance between the two divisional cores that are intermediately disposed with respect to the longitudinal direction is larger than the distance between each of the two divisional cores that are disposed at the ends and the divisional core adjacent thereto.

In FIG. 11, there is illustrated an excitation coil 1, a cylindrical member 2, a cylindrical substrate 3, a coating liquid (or a coating layer) 4, divisional cores 5*a* and 5*b* and lead terminals 10. In FIG. 11, reference numeral 11 denotes the distance between the divisional cores and the cylindrical substrate, and reference numeral 12 denotes the length in the longitudinal direction, of the core. As will be seen from FIG. 11, the length in the longitudinal direction, of the divisional cores 5*a* disposed at both ends is larger than that of the divisional cores 5*b* that are intermediately disposed.

By using plural types of divisional cores having different lengths in the longitudinal direction and varying the distances between the divisional cores as shown in FIG. 11, it is possible to enhance the degree of uniformity of the temperature distribution in the longitudinal direction of the cylindrical substrate. In the arrangement shown in FIG. 11, the distance between each core and the cylindrical substrate is the same. The inventors performed experiments with the divisional core arrangement shown in FIG. 11 to confirm that the degree of uniformity in temperature was such that the variation in temperature was about 10 to 20° C.

When the cylindrical member is heated to be dried, the temperature of its both end portions would drop as compared to the temperature of the central portion on account of the heat release due to contact with holding device (not shown) or the like provided at the end portions, while it is necessary to maintain the temperature during the drying operation within an allowable range.

Given the above situations, it is possible to control the heating temperature by arranging the lengths or dispositions in the longitudinal direction, of the divisional cores to vary magnetic reluctance in the longitudinal direction so as to adjust the magnetic flux passing through the cylindrical substrate. Specifically, the degree of uniformity of the heat generation distribution can be enhanced by arranging the divisional cores densely in both end portions in which the heat generation amount should be increased, while sparsely in the intermediate or central portion in which heat generation amount should be reduced.

While the description has been made of the arrangement in which the core is divided into four divisional cores with reference to FIG. 11, it is possible to reduce the heat generation amount in the intermediate portion relative to the end portions by dividing the core into at least two divisional cores between which an air space giving a magnetic reluctance is formed.

Figure 12:
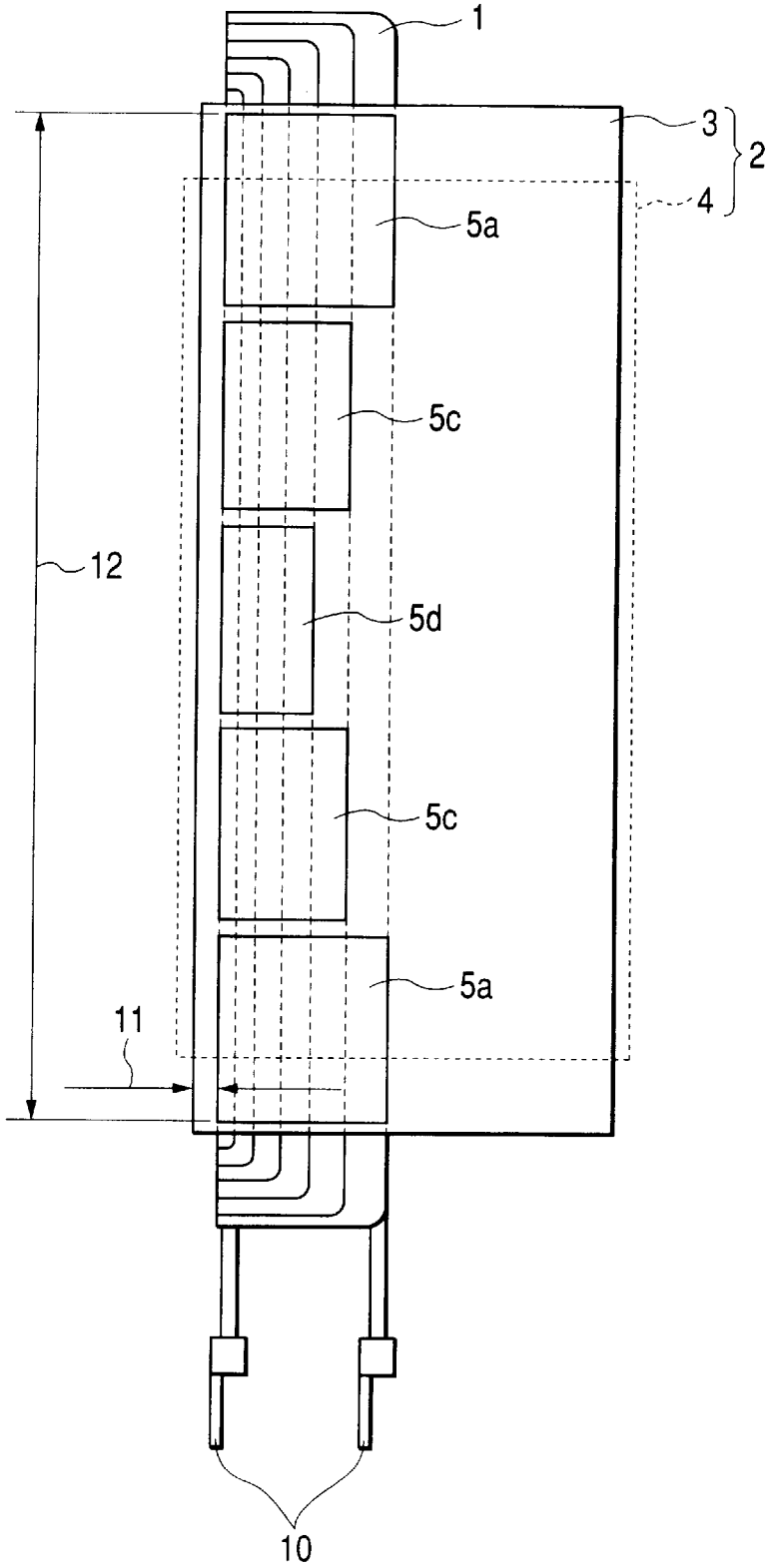
FIG. 12 shows an arrangement in which the core is divided in the longitudinal direction into five divisional cores, wherein the lengths (or thicknesses) in the radial direction of the cylindrical substrate of the divisional cores are varied in such a way that the closer to the central portion in the longitudinal direction of the cylindrical substrate the divisional core is, the smaller its length (or thickness) in the radial direction of the cylindrical substrate is.

FIG. 12 shows another arrangement in which the core is divided in the longitudinal direction into five divisional cores, wherein the lengths (or thicknesses), in the radial direction of the cylindrical substrate (which will be simply referred to as "the radial direction" hereinafter), of the divisional cores are varied in such a way that the closer to the central portion in the longitudinal direction of the cylindrical substrate the divisional core is, the smaller its length (or thickness) in the radial direction is.

In FIG. 12, there is illustrated an excitation coil 1, a cylindrical member 2, a cylindrical substrate 3, a coating liquid (or a coating layer) 4, divisional cores 5*a*, 5*b* and 5*c* and lead terminals 10. In FIG. 12, reference numeral 11 denotes the distance between the divisional cores and the cylindrical substrate, and reference numeral 12 denotes the length, in the longitudinal direction, of the core. As will be seen from FIG. 12, the length (or thickness), in the radial direction, of the divisional core 5*b* is smaller than that of the divisional core 5*a*, and the length, in the radial direction, of the divisional core 5*c* is smaller than that of the divisional core 5*b*.

By varying the thicknesses of the divisional cores as shown in FIG. 12, it is possible to enhance the degree of uniformity of the temperature distribution in the longitudinal direction of the cylindrical substrate. The inventors performed experiments with the divisional core arrangement as shown in FIG. 12 to confirm that the degree of uniformity in temperature was such that the variation in temperature was about 30° C. on the average.

Figure 13:
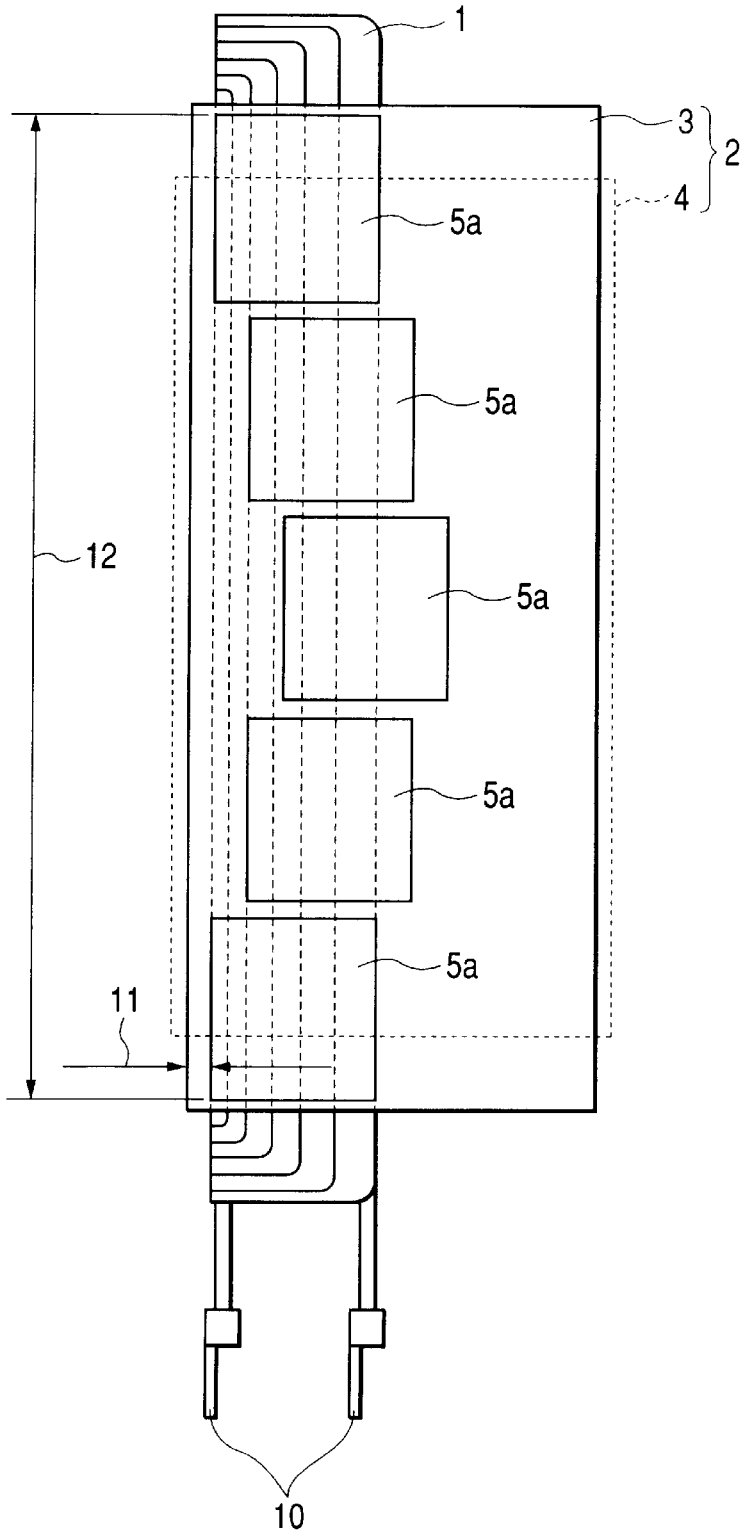
FIG. 13 shows an arrangement in which the core is divided in the longitudinal direction into five divisional cores, wherein the distances between the divisional cores and the inner surface of the cylindrical substrate are varied in such a way that the closer to the central portion in the longitudinal direction of the cylindrical substrate the divisional core is, the larger the distance between that core and the inner surface of the cylindrical substrate is.

FIG. 13 shows another arrangement in which the core is divided in the longitudinal direction into five divisional cores, wherein the distances between the divisional cores and the inner surface of the cylindrical substrate are varied in such a way that the closer to the central portion in the longitudinal direction of the cylindrical substrate the divisional core is, the larger the distance between that core and the inner surface of the cylindrical substrate is.

In FIG. 13, there is illustrated an excitation coil 1, a cylindrical member 2, a cylindrical substrate 3, a coating liquid (or a coating layer) 4, divisional cores 5*a* and lead terminals 10. In FIG. 13, reference numeral 11 denotes the distance between the divisional cores and the cylindrical substrate, and reference numeral 12 denotes the length, in the longitudinal direction, of the core. As will be seen from FIG. 13, the divisional cores are of only one type and the distances between the divisional cores and the inner surface of the cylindrical substrate are varied by arranging the dispositions of the divisional cores differently.

By varying the distances between the divisional cores and the inner surface of the cylindrical substrate as shown in FIG. 13, it is possible to enhance the degree of uniformity of the temperature distribution in the longitudinal direction of the cylindrical substrate. The inventors performed experiments with the divisional core arrangement as shown in FIG. 13 to confirm that the degree of uniformity in temperature was such that the variation in temperature was about 30° C. on the average. The arrangement shown in FIG. 13, which can enhance the degree of uniformity with only one type of divisional core, is advantageous over arrangements that use plural types of divisional cores, since it is not necessary to prepare plural types of divisional cores.

Figure 14:
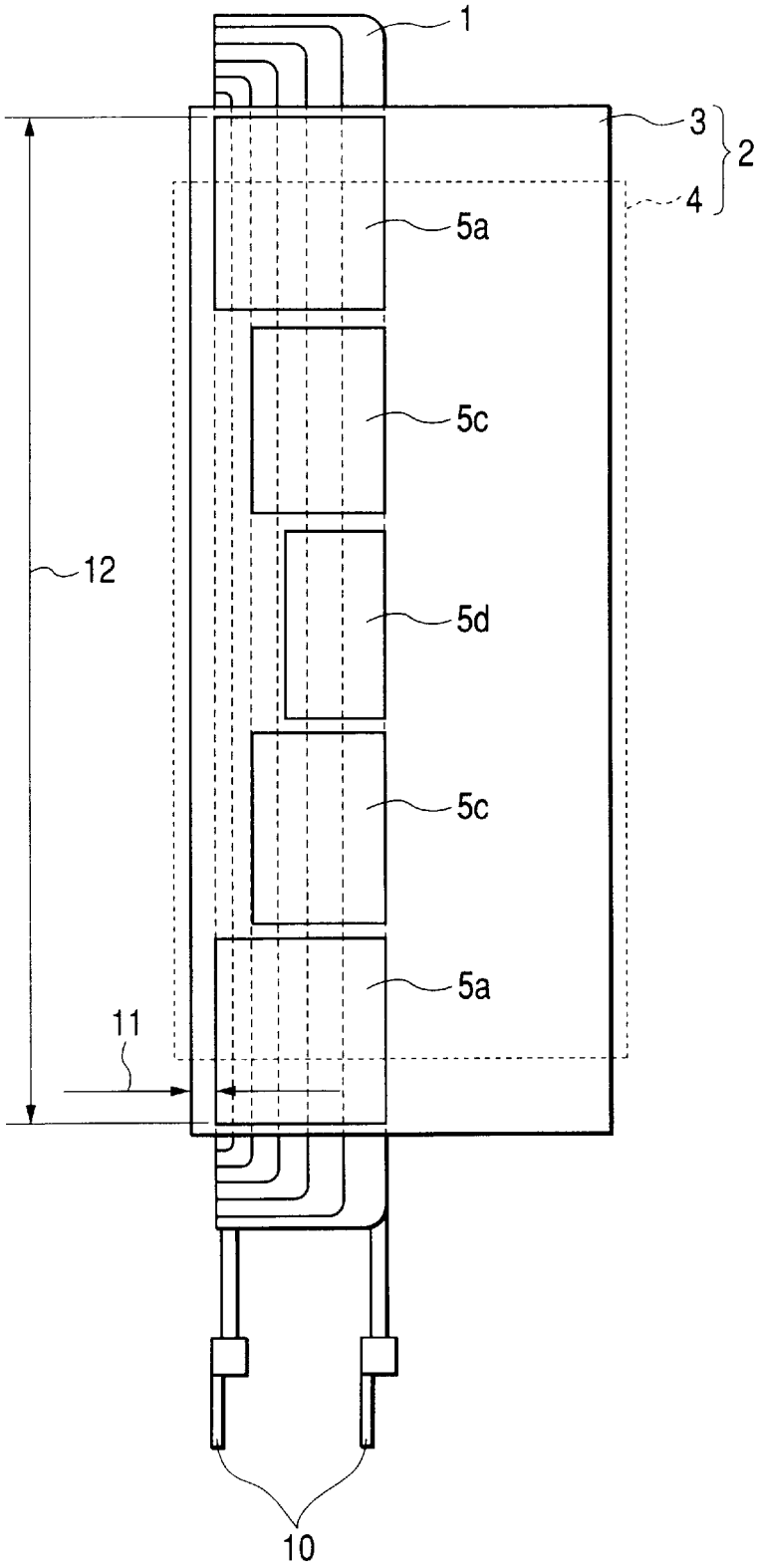
FIG. 14 shows an arrangement in which the core is divided in the longitudinal direction into five divisional cores, wherein the distances between the divisional cores and the inner surface of the cylindrical substrate are varied in such a way that the closer to the central portion in the longitudinal direction of the cylindrical substrate the divisional core is, the larger the distance between that core and the inner surface of the cylindrical substrate is.

FIG. 14 also shows an arrangement in which the core is divided in the longitudinal direction into five divisional cores, wherein the distances between the divisional cores and the inner surface of the cylindrical substrate are varied in such a way that the closer to the central portion in the longitudinal direction of the cylindrical substrate the divisional core is, the larger the distance between that core and the inner surface of the cylindrical substrate is.

In FIG. 14, there is illustrated an excitation coil 1, a cylindrical member 2, a cylindrical substrate 3, a coating liquid (or a coating layer) 4, divisional cores 5*a*, 5*b* and 5*c* and lead terminals 10. In FIG. 11, reference numeral 11 denotes the distance between the divisional cores and the cylindrical substrate, and reference numeral 12 denotes the length, in the longitudinal direction, of the core. As will be seen from FIG. 14, the length (or thickness), in the radial direction, of the divisional core 5*b* is smaller than that of the divisional core 5*a*, and the length, in the radial direction, of the divisional core 5*c* is smaller than that of the divisional core 5*b*. This arrangement is different from the arrangement shown in FIG. 13 in that the distances between the divisional cores and the inner surface are varied by using plural (i.e. three) types of divisional cores.

By varying the distances between the divisional cores and the inner surface of the cylindrical substrate as shown in FIG. 14, it is possible to enhance the degree of uniformity of the temperature distribution in the longitudinal direction of the cylindrical substrate. The inventors performed experiments with the divisional core arrangement as shown in FIG. 14 to confirm that the degree of uniformity in temperature was such that the variation in temperature was about 30° C. on the average.

In the case in which divisional cores are used as in the arrangements shown in FIGS. 10 to 14, it is preferable that divisional cores be arranged with spaces therebetween. In addition, it is preferable that the sum of the lengths, in the longitudinal direction, of those spaces makes up 10 to 50% of the distance between both longitudinal ends of the core.

In addition, the above-mentioned experiments for confirming the uniformity enhancing effect were performed by measuring the temperature distribution of the cylindrical substrate by means of a thermo camera, in the state that a tape for compensating radiation ratio is attached on the surface of the cylindrical substrate that is held by resin members at the upper and lower ends thereof.

In the following, an experiment concerning the distance between the inner surface of the cylindrical substrate and the excitation coil will be described with reference to FIGS. 15A to 15D and FIGS. 16A and 16B.

Figure 15A:
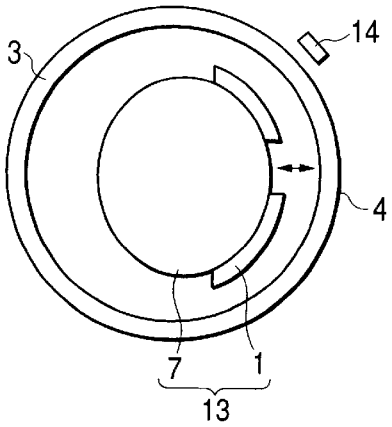
FIG. 15A shows a state in which induction heating means having an excitation coil has been inserted into the interior of a cylindrical substrate.
Figure 15B:
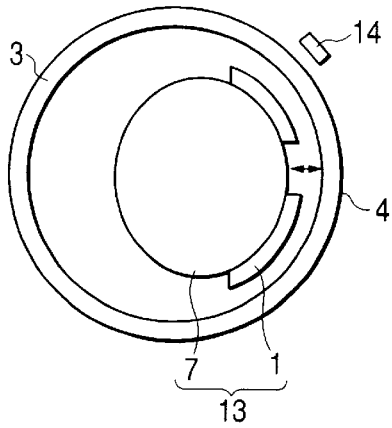
FIG. 15B shows a state in which induction heating means having an excitation coil inserted in the interior of a cylindrical substrate has been moved by driving means (not shown) in order for the distance between the excitation coil and the inner surface of the cylindrical substrate to be reduced.
Figure 15C:
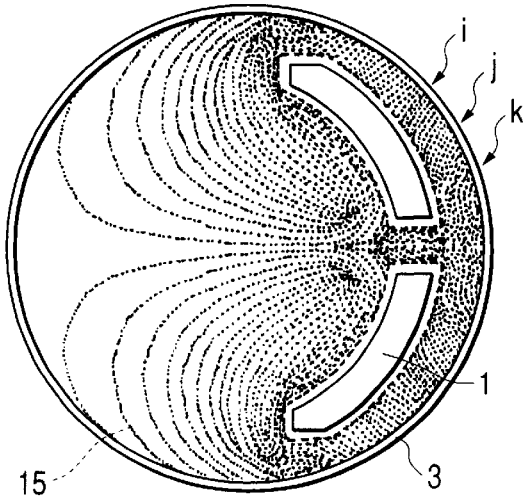
FIG. 15C shows the distribution of the magnetic flux under the state shown in FIG. 15A.

FIG. 15A shows a state in which induction heating means having an excitation coil has been inserted into the interior of a cylindrical substrate, and FIG. 15C shows the distribution of the magnetic flux in that state. In FIG. 15A, the distance between the inner surface of the cylindrical substrate and the excitation coil is 10 mm.

Figure 15D:
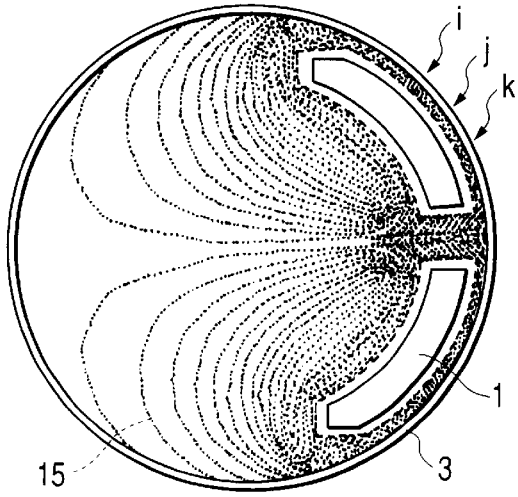
FIG. 15D shows the distribution of the magnetic flux under the state shown in FIG. 15B.

FIG. 15B shows a state in which induction heating means having an excitation coil inserted in the interior of a cylindrical substrate has been moved by driving means (not shown) to a position at which the distance between the excitation coil and the inner surface of the cylindrical substrate is 5 mm, and FIG. 15D shows the distribution of the magnetic flux under that state.

In FIGS. 15A and 15B, there is illustrated an excitation coil 1, a holder 7, an induction heating means 13 having the excitation coil, a cylindrical substrate 3, a coating liquid (or a coating layer) 4 applied on the cylindrical substrate and a temperature sensing element 14. In FIGS. 15C and 15D, reference numeral 1 denotes the excitation coil, reference numeral 3 denotes the cylindrical substrate, reference numeral 15 denotes the magnetic fluxes and reference characters i, j and k denote measurement positions at which the measurement is effected.

Figure 16A:
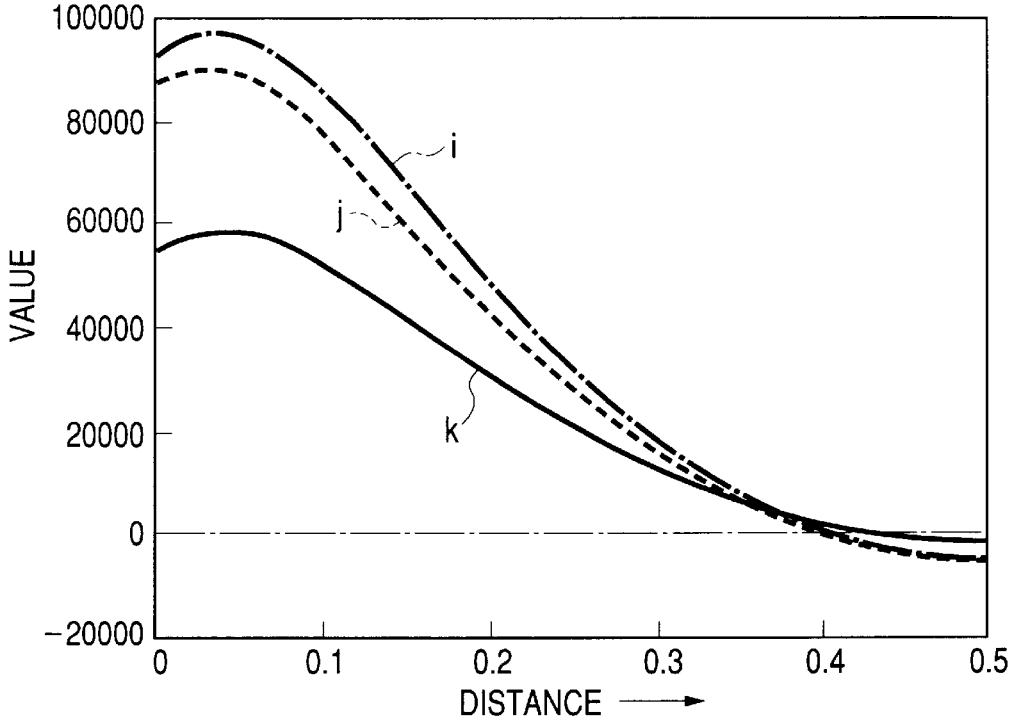
FIG. 16A is a graph showing the values of current flowing in the cross section of the wall of the cylindrical substrate at measurement positions i, j and k shown in FIG. 15A.
Figure 16B:
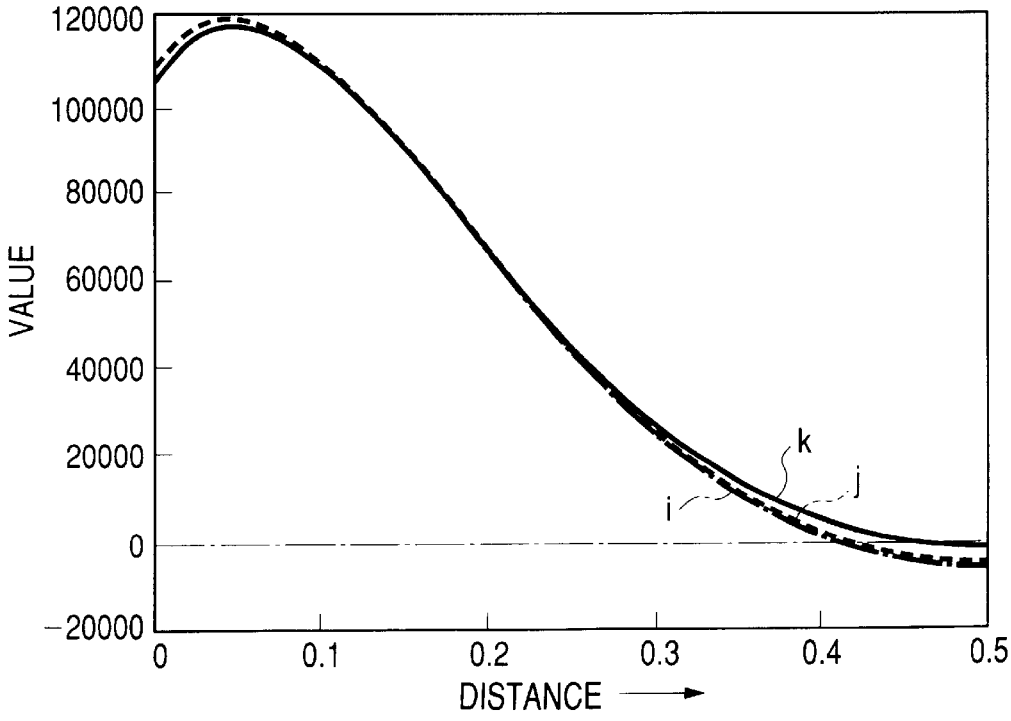
FIG. 16B is a graph showing the values of current flowing in the cross section of the wall of the cylindrical substrate at measurement positions i, j and k shown in FIG. 15B.

FIG. 16A is a graph showing the values of current flowing in the cross section of the wall of the cylindrical substrate at the respective positions i, j and k shown in FIG. 15A, and FIG. 16B is a graph showing the values of current flowing in the cross section of the wall of the cylindrical substrate at the respective positions i, j and k shown in FIG. 15B. In each of FIGS. 16A and 16B, the abscissa corresponds to the position in the wall of the cylindrical substrate represented by the distance in the wall thickness direction (i.e. radial direction) from the inner surface of the cylindrical substrate, while the ordinate represents the current density value.

First, the induction heating means 13 having the excitation coil 1 was inserted into the interior of the cylindrical substrate 3 coaxially as shown in FIG. 15A, and then the induction heating means 13 was moved closer to the inner surface of the cylindrical substrate 3 as shown in FIG. 15B. In each of the states shown in FIGS. 15A and 15B, a high frequency current was supplied to the excitation coil 1, so that the cylindrical substrate 3 and the coating liquid (or coating layer) 4 applied on the cylindrical substrate were heated.

As shown in FIGS. 15C and 15D, when the excitation coil 1 was disposed at the position shown in FIG. 15B, the magnetic flux 15 permeated deeper into the cylindrical substrate than in the case in which the excitation coil was disposed at the position shown in FIG. 15A, and as shown in FIGS. 16A and 16B, larger currents flowed in the case of FIG. 15B than in the case of FIG. 15A. In other words, the current values shown in the current value graph of FIG. 16B under the excitation coil position shown in FIG. 15B was increased as compared to the current values shown in the current value graph shown in FIG. 16A under the excitation coil position shown in FIG. 15A, namely, the power supplied to the cylindrical substrate is increased in the excitation coil position shown in FIG. 15B as compared to that shown in FIG. 15A.

Figure 17:
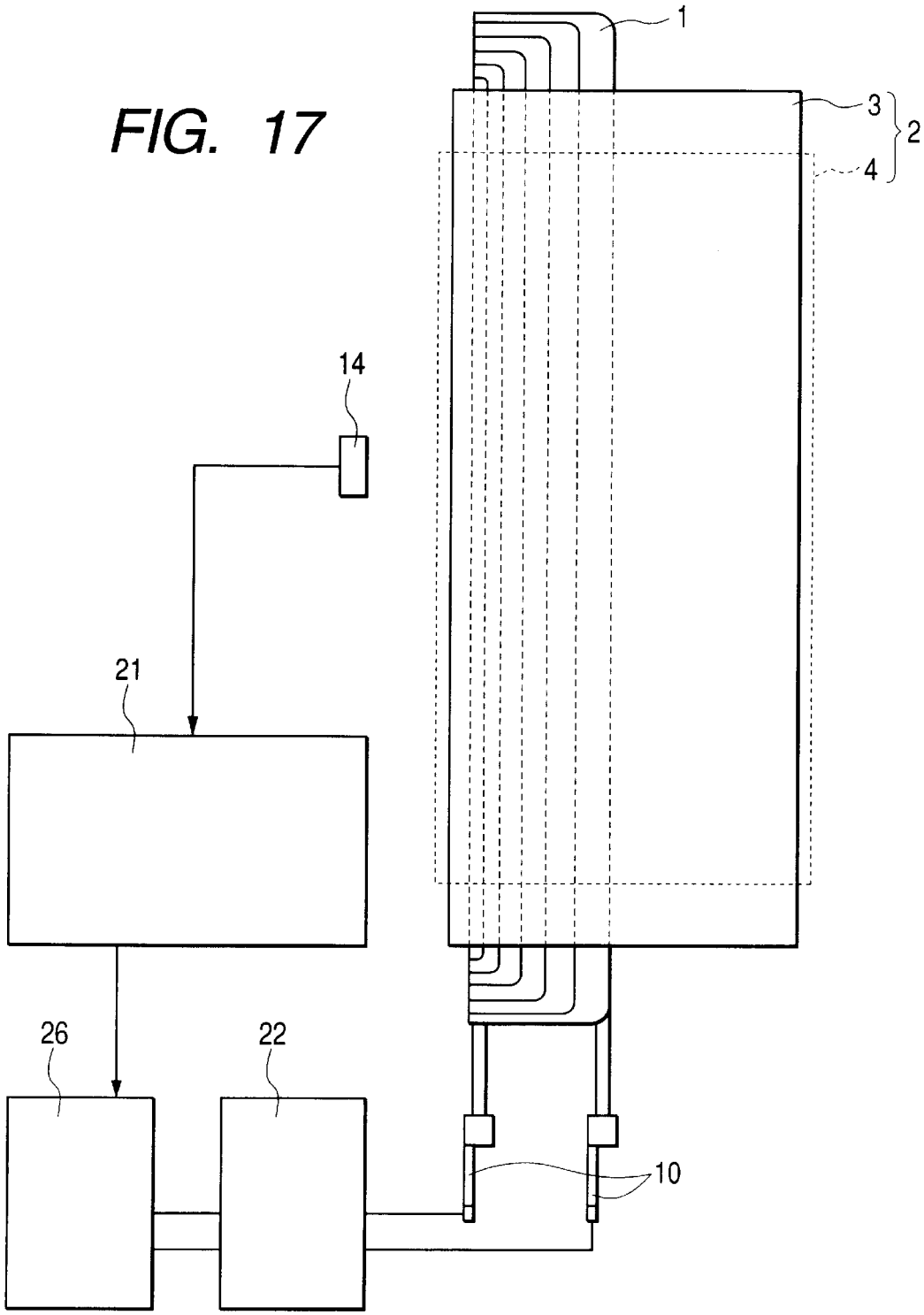
FIG. 17 is an example of a circuit diagram (or a block diagram) of an apparatus for manufacturing cylindrical members.
Figure 18:
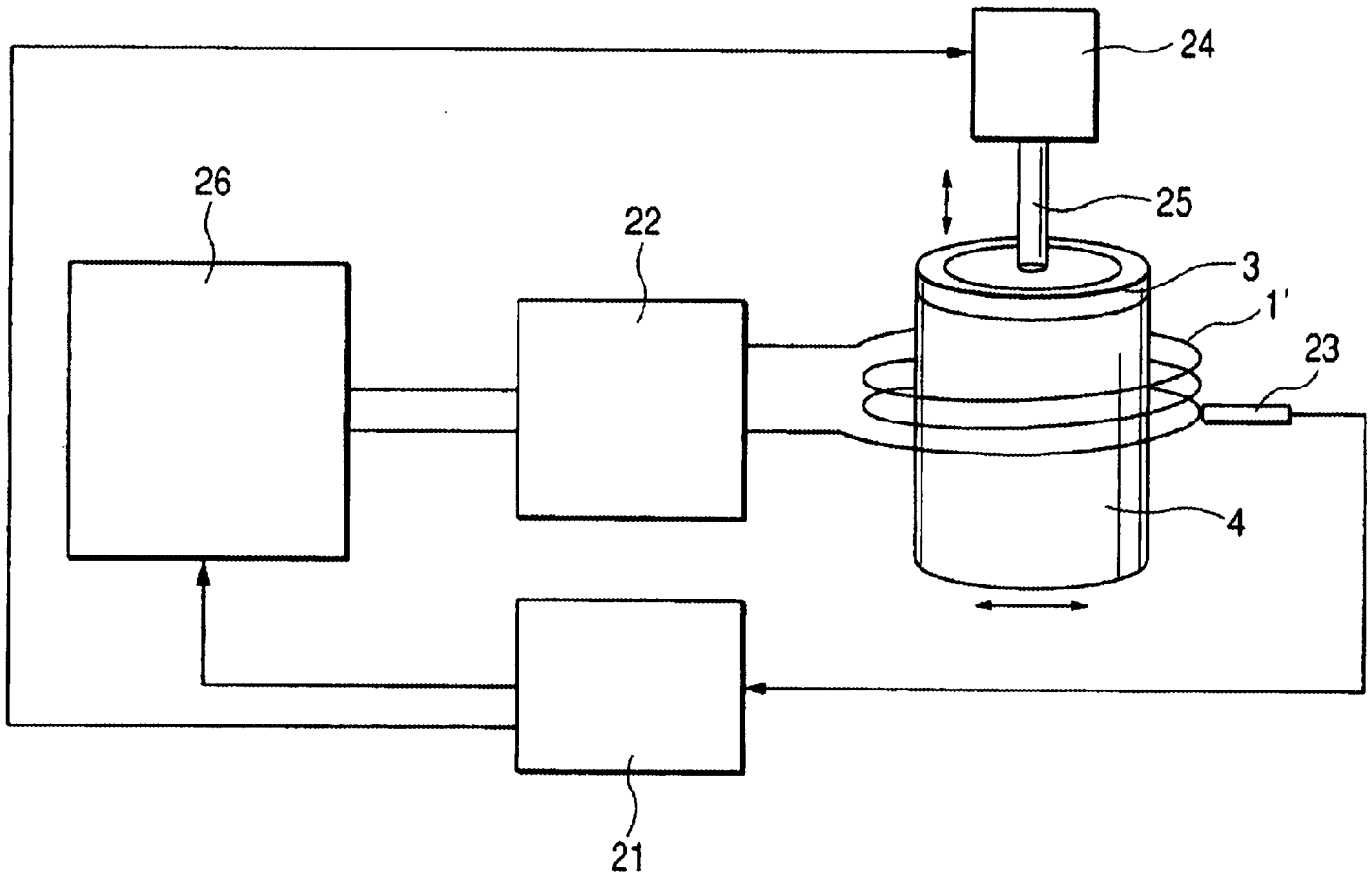
FIG. 18 PRIOR ART
FIG. 18 schematically shows a prior art arrangement for performing induction heating by supplying a high frequency current to an excitation coil that is wound in such a way as to surround the photosensitive member for electrophotography externally.

An example of a circuit diagram (or a block diagram) of an apparatus for manufacturing cylindrical members according to the present invention is shown in FIG. 17, though the structures of the cylindrical substrate and induction heating means, etc. are not limited to those shown in FIG. 17.

In the apparatus shown in FIG. 17, the induction heating means having an excitation coil 1 is disposed in the interior of a cylindrical substrate 3 made of an electrically conductive material, on the outer peripheral surface of which coating liquid 4 for forming a coating layer has been applied. While the cylindrical substrate 3 is being rotated by a rotation mechanism (not shown), a high frequency current is supplied from a high frequency oscillator 26 to the excitation coil 1 via a matching device 22, so that the induction heating is performed on the cylindrical substrate 3. The apparatus is equipped with a temperature sensing element 14 to monitor the temperature of the cylindrical substrate 3. The monitor signal of the temperature sensing element 14 is fed back to the high frequency oscillator 26 via a control apparatus 21 so that the temperature of the cylindrical substrate 3 would be controlled to be a prescribed value. Thus, the coating liquid (or coating layer) 4 on the cylindrical substrate is dried, and a cylindrical member 2 is produced.

As will be apparent, the apparatus may be arranged to perform the induction heating while rotating the induction heating means having the excitation coil instead of rotating the cylindrical substrate. Alternatively, the apparatus may be arranged to have an excitation coil that extends all along the inner peripheral surface of the cylindrical substrate and to perform the induction heating without a rotation mechanism for rotating the cylindrical substrate or the induction heating means. Furthermore, the apparatus may perform the induction heating using induction heating means that have a core (which may include divisional cores).

With the invention as described in the foregoing, it is possible to provide a method and apparatus for manufacturing cylindrical members that can produce cylindrical substrates safely with small variation in their qualities and at an advantageous cost.

What is claimed is:

1. A method for manufacturing a cylindrical member including a cylindrical substrate and at least one coating layer thereon, comprising:

an applying step of applying a coating liquid on said cylindrical substrate; and a drying step of drying the coating liquid that has been applied in said applying step by induction heating means to form said coating layer;

wherein, said induction heating means is disposed in an interior of said cylindrical substrate;

said induction heating means includes an excitation coil to generate a magnetic flux in a direction perpendicular to an axial direction of said cylindrical member; and said excitation coil is disposed along an inner surface of said cylindrical substrate.

2. A method for manufacturing a cylindrical member according to claim 1, wherein said excitation coil is configured to extend all along the circumference of the inner surface of the cylindrical substrate.

3. A method for manufacturing a cylindrical member according to claim 1, said excitation coil for generating magnetic flux in a direction perpendicular to the axial direction of the cylindrical member comprises an excitation coil that is configured to be folded in a longitudinal direction of said cylindrical substrate.

4. A method for manufacturing a cylindrical member according to claim 1, wherein said excitation coil is composed of two or more coils so as to extend all along the circumference of the inner surface of the cylindrical substrate.

5. A method for manufacturing a cylindrical member according to claim 1, said excitation coil is disposed in such a way that the distance between the excitation coil and the inner surface of the cylindrical substrate is more than 0 mm and not more than 5 mm.

6. A method for manufacturing a cylindrical member according to claim 1, both longitudinal ends of said excitation coil stay within a space defined by both longitudinal ends of said cylindrical substrate.

7. A method for manufacturing a cylindrical member according to claim 1, wherein said induction heating means includes said excitation coil and a core provided in an interior space of said excitation coil.

8. A method for manufacturing a cylindrical member according to claim 7, wherein both longitudinal ends of said core stay within a space defined by both longitudinal ends of said cylindrical substrate.

9. A method for manufacturing a cylindrical member according to claim 7, wherein said core is divided in the longitudinal direction into at least three divisional cores, and wherein a length, in the longitudinal direction, of the divisional core that is intermediately disposed with respect to the longitudinal direction is shorter than a length, in the longitudinal direction, of each of the divisional cores disposed at both ends.

10. A method for manufacturing a cylindrical member according to claim 7, wherein said core is divided in the longitudinal direction into at least three divisional cores, and wherein a distance between the divisional core that is intermediately disposed with respect to the longitudinal direction and the inner surface of the cylindrical substrate is larger than a distance between each of the divisional cores disposed at both ends and the inner surface of the cylindrical substrate.

11. A method for manufacturing a cylindrical member according to claim 7, wherein said core is divided in the longitudinal direction into at least four divisional cores, and wherein a distance between the divisional cores that are intermediately disposed with respect to the longitudinal direction is larger than a distance between each of the divisional cores disposed at both ends and the divisional core adjacent thereto.

12. A method for manufacturing a cylindrical member according to claim 7, wherein said excitation coil and said core are secured to a holder that is provided in the interior of said cylindrical substrate coaxially.

13. A method for manufacturing a cylindrical member according to claim 1, wherein said cylindrical substrate is a substrate for a photosensitive member for electrophotography.

14. An apparatus for manufacturing a cylindrical member including a cylindrical substrate and at least one coating layer thereon, comprising:

applying means for applying a coating liquid on said cylindrical substrate; and drying means for drying the coating liquid that has been applied by said applying means by induction heating to form said coating layer;

wherein, said drying means includes induction heating means for performing induction heating;

said induction heating means is disposed in an interior of said cylindrical substrate;

said induction heating means includes an excitation coil to generate a magnetic flux in a direction perpendicular to an axial direction of said cylindrical substrate; and said excitation coil is disposed along an inner surface of said cylindrical substrate.

15. An apparatus for manufacturing a cylindrical member according to claim 14, wherein said excitation coil is configured to extend all along the circumference of the inner surface of the cylindrical substrate.

16. An apparatus for manufacturing a cylindrical member according to claim 14, said excitation coil for generating magnetic flux in a direction perpendicular to the axial direction of the cylindrical member comprises an excitation coil that is configured to be folded in a longitudinal direction of said cylindrical substrate.

17. An apparatus for manufacturing a cylindrical member according to claim 14, wherein said excitation coil is composed of two or more coils so as to extend all along the circumference of the inner surface of the cylindrical substrate.

18. An apparatus for manufacturing a cylindrical member according to claim 14, said excitation coil is disposed in such a way that the distance between the excitation coil and the inner surface of the cylindrical substrate is more than 0 mm and not more than 5 mm.

19. An apparatus for manufacturing a cylindrical member according to claim 14, both longitudinal ends of said excitation coil stay within a space defined by both longitudinal ends of said cylindrical substrate.

20. An apparatus for manufacturing a cylindrical member according to claim 14, wherein said induction heating means includes said excitation coil and a core provided in an interior space of said excitation coil.

21. An apparatus for manufacturing a cylindrical member according to claim 20, wherein both longitudinal ends of said core stay within a space defined by both longitudinal ends of said cylindrical substrate.

22. An apparatus for manufacturing a cylindrical member according to claim 20, wherein said core is divided in the longitudinal direction into at least three divisional cores, and wherein a length, in the longitudinal direction, of the divisional core that is intermediately disposed with respect to the longitudinal direction is shorter than a length, in the longitudinal direction, of each of the divisional cores disposed at both ends.

23. An apparatus for manufacturing a cylindrical member according to claim 20, wherein said core is divided in the longitudinal direction into at least three divisional cores, and wherein a distance between the divisional core that is intermediately disposed with respect to the longitudinal direction and the inner surface of the cylindrical substrate is larger than a distance between each of the divisional cores disposed at both ends and the inner surface of the cylindrical substrate.

24. An apparatus for manufacturing a cylindrical member according to claim 20, wherein said core is divided in the longitudinal direction into at least four divisional cores, and wherein a distance between the divisional cores that are intermediately disposed with respect to the longitudinal direction is larger than a distance between each of the divisional cores disposed at both ends and the divisional core adjacent thereto.

25. An apparatus for manufacturing a cylindrical member according to claim 20, wherein said excitation coil and said core are secured to a holder that is provided in the interior of said cylindrical substrate coaxially.

26. An apparatus for manufacturing a cylindrical member according to claim 14, wherein said cylindrical substrate is a substrate for a photosensitive member for electrophotography.

* * * * *